US007082803B2

(12) United States Patent
Hario et al.

(10) Patent No.: US 7,082,803 B2
(45) Date of Patent: Aug. 1, 2006

(54) HEMMING DEVICE AND HEMMING METHOD

(75) Inventors: Hidehiko Hario, Ayase (JP); Yasuyuki Matsumoto, Fujisawa (JP)

(73) Assignee: Nissan Motor Co., Ltd., Kanagawa-ken (JP)

( * ) Notice: Subject to any disclaimer, the term of this patent is extended or adjusted under 35 U.S.C. 154(b) by 100 days.

(21) Appl. No.: 10/841,558

(22) Filed: May 10, 2004

(65) Prior Publication Data

US 2004/0206149 A1 Oct. 21, 2004

Related U.S. Application Data

(62) Division of application No. 09/805,134, filed on Mar. 14, 2001, now Pat. No. 6,739,168.

(30) Foreign Application Priority Data

Mar. 17, 2000 (JP) ..... P2000-76797
Apr. 5, 2000 (JP) ..... P2000-103874
Sep. 5, 2000 (JP) ..... P2000-268785

(51) Int. Cl.
*B21D 43/10* (2006.01)

(52) U.S. Cl. ..... 72/306; 72/422; 29/243.58

(58) Field of Classification Search ..... 72/306, 72/319, 323, 312, 422; 29/243.57, 243.58
See application file for complete search history.

(56) References Cited

U.S. PATENT DOCUMENTS

| | | | | |
|---|---|---|---|---|
| 3,092,057 | A * | 6/1963 | Warshilek | 29/243.58 |
| 5,150,508 | A | 9/1992 | St. Denise | |
| 5,188,276 | A * | 2/1993 | Furuya et al. | 228/6.1 |
| 5,454,261 | A | 10/1995 | Campian | |
| 6,125,683 | A * | 10/2000 | Toeniskoetter | 72/426 |
| 6,182,492 | B1 | 2/2001 | Raffin et al. | |
| 6,314,783 | B1 | 11/2001 | Patrick | |
| 6,439,371 | B1 * | 8/2002 | Baulier | 198/468.2 |

FOREIGN PATENT DOCUMENTS

| | | |
|---|---|---|
| FR | 1322218 | 2/1963 |
| FR | 1445675 | 6/1966 |
| JP | 53-44466 | 4/1978 |
| JP | 7-68324 | * 3/1995 |
| JP | 10-249454 | 9/1998 |
| JP | 11-333535 | * 12/1999 |
| JP | 2001-162339 | 6/2001 |
| WO | WO 99/36203 | 7/1999 |

* cited by examiner

*Primary Examiner*—Daniel C. Crane
(74) *Attorney, Agent, or Firm*—McDermott Will & Emery LLP

(57) ABSTRACT

A hand transport section holds and transports a workplace grip hand for gripping and positioning a workpiece. The hand transport section mounts the workpiece grip hand on a hand mount so as to set the workpiece on a lower die. The hand transport section releases the workpiece grip hand and retracts. The hemming device hems the workpiece with the lower die and an upper die located above the lower die.

7 Claims, 24 Drawing Sheets

HEMMING DEVICE AND HEMMING METHOD

This application is a Division of Ser. No. 09/805,134, filed Mar. 14, 2001, now U.S. Pat. No. 6,739,168.

BACKGROUND OF THE INVENTION

1. Field of the Invention

The present invention relates to a hemming device and a hemming method for hemming a plate-like workpiece.

2. Description of Related Art

Conventionally, while the inner panel and the outer panel, for example, of a rear door which are the panel members of a vehicle are assembled with each other, hemming for hemming the peripheral edge of the outer panel and superposing the hemmed peripheral edge thereof on the peripheral edge of the inner panel is carried out by a hemming device shown in FIG. 1 which is a side view of the hemming device and in FIG. 2 which is a plan view thereof.

In this hemming device, a workpiece W is positioned and set on a hemi die 3 disposed on a base 1 in a state in which the outer panel 5 is provided below an inner panel 7. The inner panel 7 is positioned and fixedly positioned on this upper position by a positioning jig 9 which is vertically moved by a cylinder 8. The workpiece W thus positioned is provisionally hemmed by a plurality of pre-hemming punches 11 provided around the workpiece W and then finally hemmed by hemming punches 13 provided to correspond to the respective pre-hemming punches 11.

The hemming punches 13 and the pre-hemming punches 11 are actuated by hydraulic cylinders 19 rotatably supported by brackets 15 fixed to the base 1 through rotation support shafts 17, respectively. That is to say, if the hydraulic cylinder 19 is driven, the piston rode 21 of the cylinder 19 advances and a punch holder 23 having hemming punches 13 on a tip end thereof rotates about a rotation support shaft 27 in an arrow A direction relative to the bracket 25 on the base 1, whereby the final hemming is carried out by the hemming punches 13.

On the other hand, the pre-hemming punches 11 carry out provisional hemming prior to the hemming by the hemming punches 13 by advancing to the workpiece W by the rotational operation of the punch holder 23 in the arrow A direction and then retreat. That is to say, using one hydraulic cylinder 19, the provisional hemming by the pre-hemming punches 11 and the final hemming by the hemming punches 13 are carried out in succession.

As for working units $U_s$ and $U_c$ each consisting of the hemming punch 13, the pre-hemming punch 11, the hydraulic cylinder 19 driving the respective punches and the like, a total of eight, i.e., four working units ($U_s$) corresponding to the linear portion of a generally rectangular rear door and four working units ($U_c$) corresponding to the corner portions of the rear door, are provided so as to hem the entire periphery of the workpiece W as shown in FIG. 2.

SUMMARY OF THE INVENTION

However, the above-stated conventional hemming device has the following disadvantages:

(1) The hemming device is constituted to carry out hemming by the rotation of each punch holder 23. Due to this, all of the eight working units cannot be actuated simultaneously so as to prevent adjacent working units from interfering with one another. Instead, it is necessary to use different operation timing among the respective working units such as, for example, to actuate the working units $U_c$ for corner portions prior to the working units $U_s$ for the linear portions. As a result, the cycle time of the working operation becomes disadvantageously longer.

(2) If the shape of the workpiece W is such that the vertical position of a region to be hemmed by one working unit changes along the peripheral edge portion in FIG. 1, the approach angles of the pre-hemming punches 11 with respect to the workpiece W become uneven. This makes provisional hemming accuracy unstable and degrades working quality.

(3) It is necessary to set the direction in which the hemming punch 13 applies hemming pressure to be perpendicular to the surface of the workpiece W and to appropriately set the approach angles of the pre-hemming punch 11 with respect to the workpiece W. Due to this, it is difficult to standardize hemming punches and the hemming punches should be set in accordance with the shape of each workpiece, thereby pushing up cost.

(4) To work a corner portion, a dedicated small working unit $U_c$ is required. The number of overall working units increases accordingly to thereby push up cost.

(5) The stroke of the hydraulic cylinder 19 tends to be long, which makes the overall working unit large in size. If the hydraulic cylinder 19 is disposed to be closer to the base 1 so as to shorten the stroke, then a driving force intensifies to thereby make the hydraulic cylinder 19 larger in size.

(6) The hemming device is constituted such that hemming pressure is generated by rotating the punch holder 23 by the hydraulic cylinder 19 attached to the base 1 through the bracket 15 and received on the base 1 side. This requires the rigidity of the base 1 and the overall working unit, making the overall working unit large in size.

Meanwhile, the conventional hemming device stated above employs the positioning jig 9 to position the inner panel 7. Since this positioning jig 9 has a relatively long vertical stroke, the accuracy thereof deteriorates and the size is made large. Besides, it is necessary to provide a transport device dedicated to the transport of the workpiece such as a belt conveyer in addition to the positioning jig 9 so as to set the workpiece W on the hemming die 3. This makes the entire facility large in size.

It is, therefore, an object of the present invention to suppress cost increase by decreasing the number of working units, preventing each working unit from becoming large in size, and to reduce processing time by allowing the respective working units to simultaneously operate without interfering with one another even if the units are adjacent each other.

It is also an object of the present invention to improve workpiece positioning accuracy, to dispense with a transport device dedicated to the transport of a workpiece and to thereby make entire facility small in size.

To obtain the above-stated objects, there is provided a hemming device comprising: a hemming punch provided on an upper portion of a C-shaped frame; a hemming die provided on a base on which the C-shaped frame is disposed, and vertically movable to be adjacent to and away from the hemming punch; and a driving section provided between said hemming die and a lower portion of the C-shaped frame and raising said hemming die to hem a workpiece set on said hemming die.

According to the hemming device thus constituted, by raising the hemming die using the driving section, the workpiece on the hemming die is hemmed between the hemming die and the hemming punch on the upper portion of the C-shaped frame.

Further, to obtain the above objects, there is provided a hemming method comprising: setting a workpiece on a hemming die vertically movably provided on a base in a state while a C-shaped frame and a pre-hemming punch provided at the C-shaped frame are retreated; advancing the C-shaped frame and the pre-hemming punch provided at the C-shaped frame; raising the hemming die by a driving section provided between a lower portion of the C-shaped frame and the hemming die, and conducting provisional hemming to the workpiece by the pre-hemming punch; retreating the pre-hemming punch; and raising the hemming die by the driving section, and conducting hemming to the workpiece by the hemming punch provided on an upper portion of the C-shaped frame.

According to the above-stated hemming method, by the raising operation of the hemming die by driving the driving section above the C-shaped frame, the workpiece is hemmed by the pre-hemming punch and the hemming punch provided on the C-shaped frame side.

Moreover, to obtain the above objects, there is provided a hemming device for hemming a peripheral edge of a workpiece using a lower die, on which the workpiece is set, and an upper die arranged above the lower die, the hemming device comprising: a hand mount provided on the lower die side; a workpiece grip hand positioning and gripping the workpiece, and positioned and mounted on the hand mount so as to position and set the workpiece on the lower die; and a hand transport section detachably holding the workpiece grip hand.

According to the hemming device thus constituted, the workpiece grip hand which positions and grips the workpiece is positioned and mounted on the hand mount while being held by the hand transport section. At this moment, the workpiece is set on the lower die and hemmed by the lower die and the upper die while releasing the holding of the workpiece grip hand by the hand transport section.

Furthermore, to obtain the above objects, there is provided a hemming method comprising: holding and transporting a workpiece grip hand positioning and gripping a workpiece by a hand transport section; mounting the workpiece grip hand on a hand mount so as to set the workpiece on the lower die; and hemming the workpiece by the lower die and an upper die located above the lower die.

According to the above-stated hemming device, the workpiece grip hand held by the hand transport section functions to both position and grip the workpiece and transport the workpiece.

The nature, principle and utility of the invention will become more apparent from the following detailed description when read in conjunction with the accompanying drawings.

DESCRIPTION OF THE PREFERRED EMBODIMENTS

The embodiments of the present invention will be described hereinafter with reference to the accompanying drawings.

First Embodiment

Figure 1:
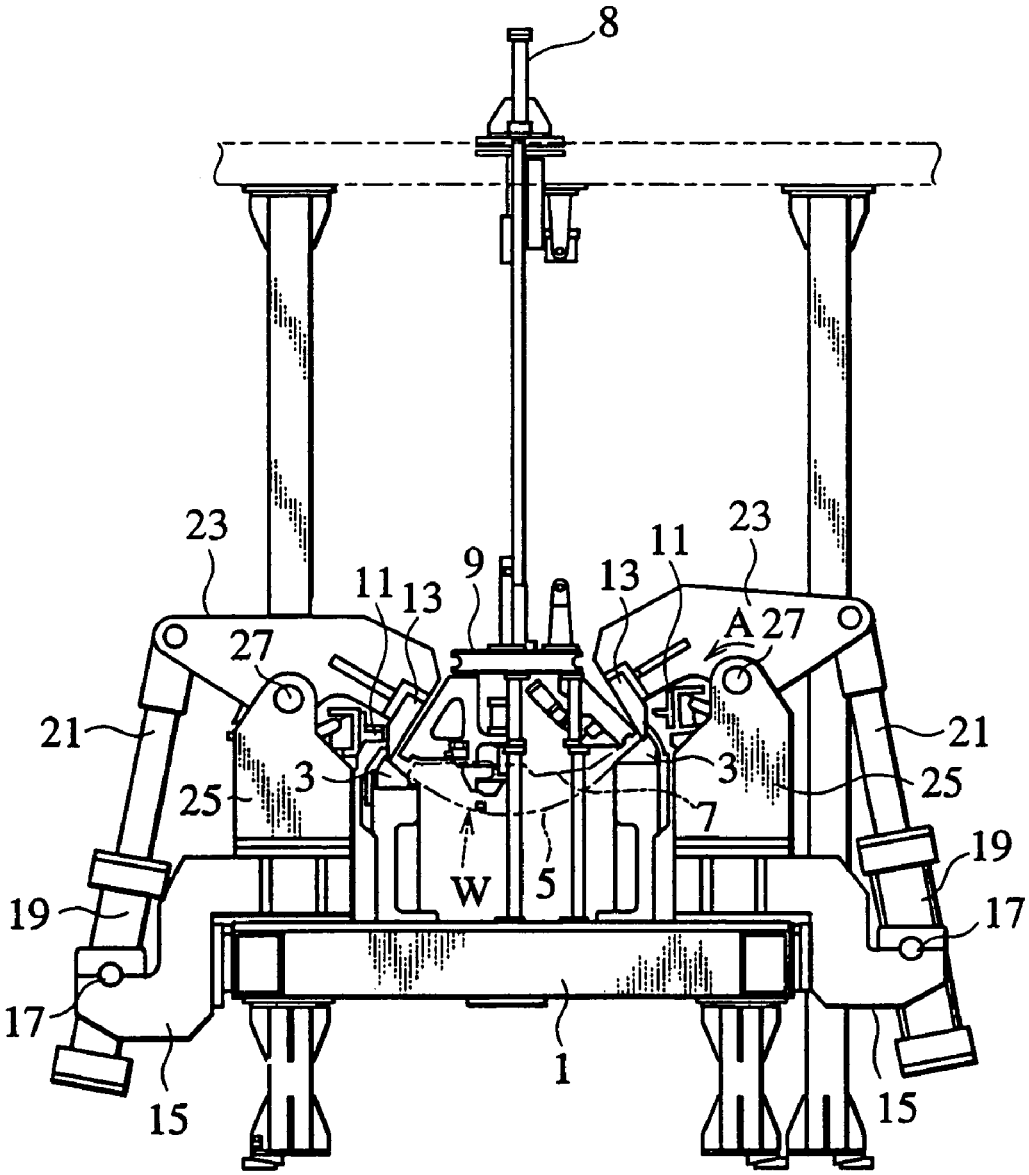
FIG.1 PRIOR ART
FIG. 1 is a side view of a hemming device showing prior art.
Figure 2:
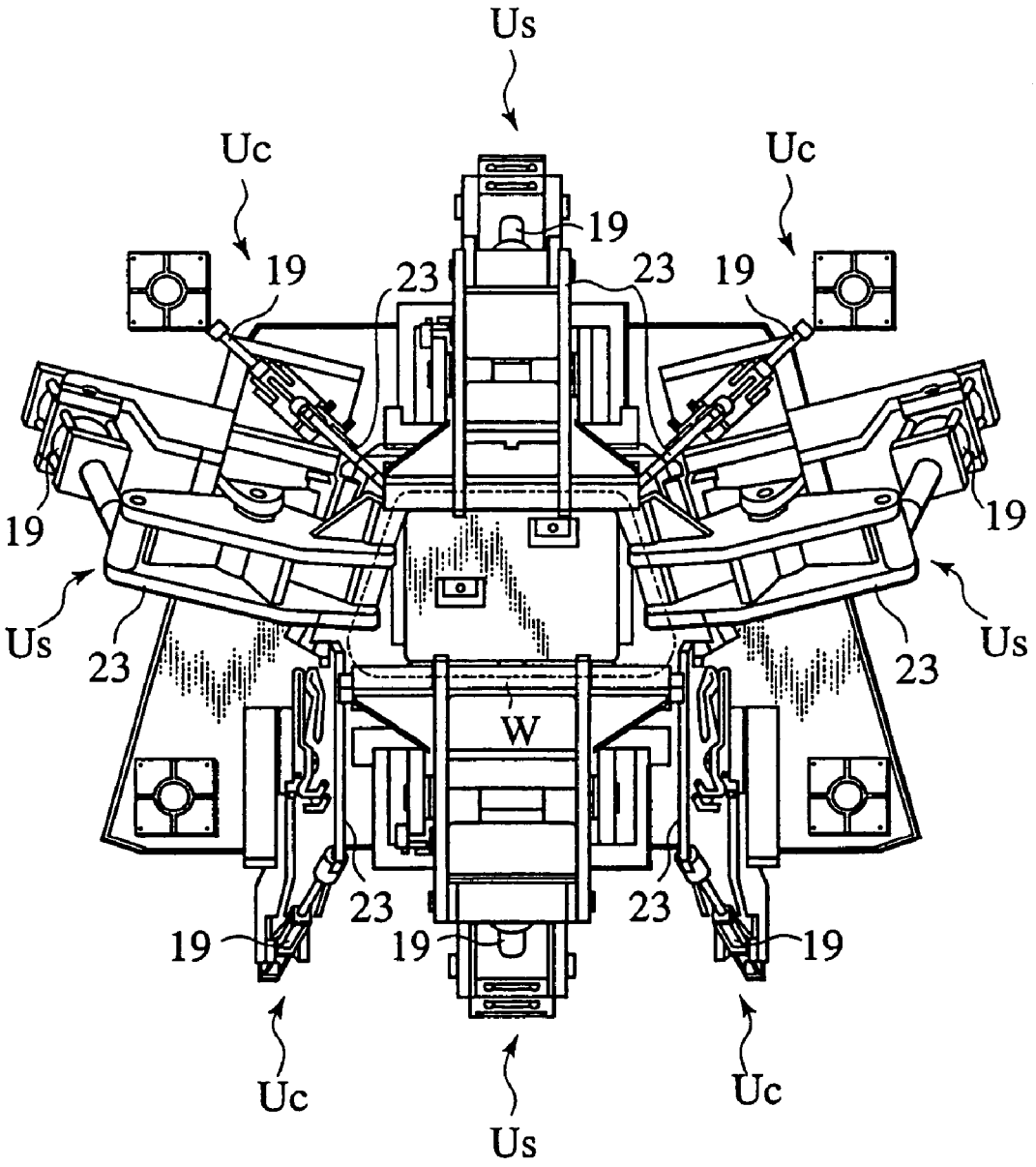
FIG.2 PRIOR ART
FIG. 2 is a plan view of the hemming device shown in FIG. 1.
Figure 3:
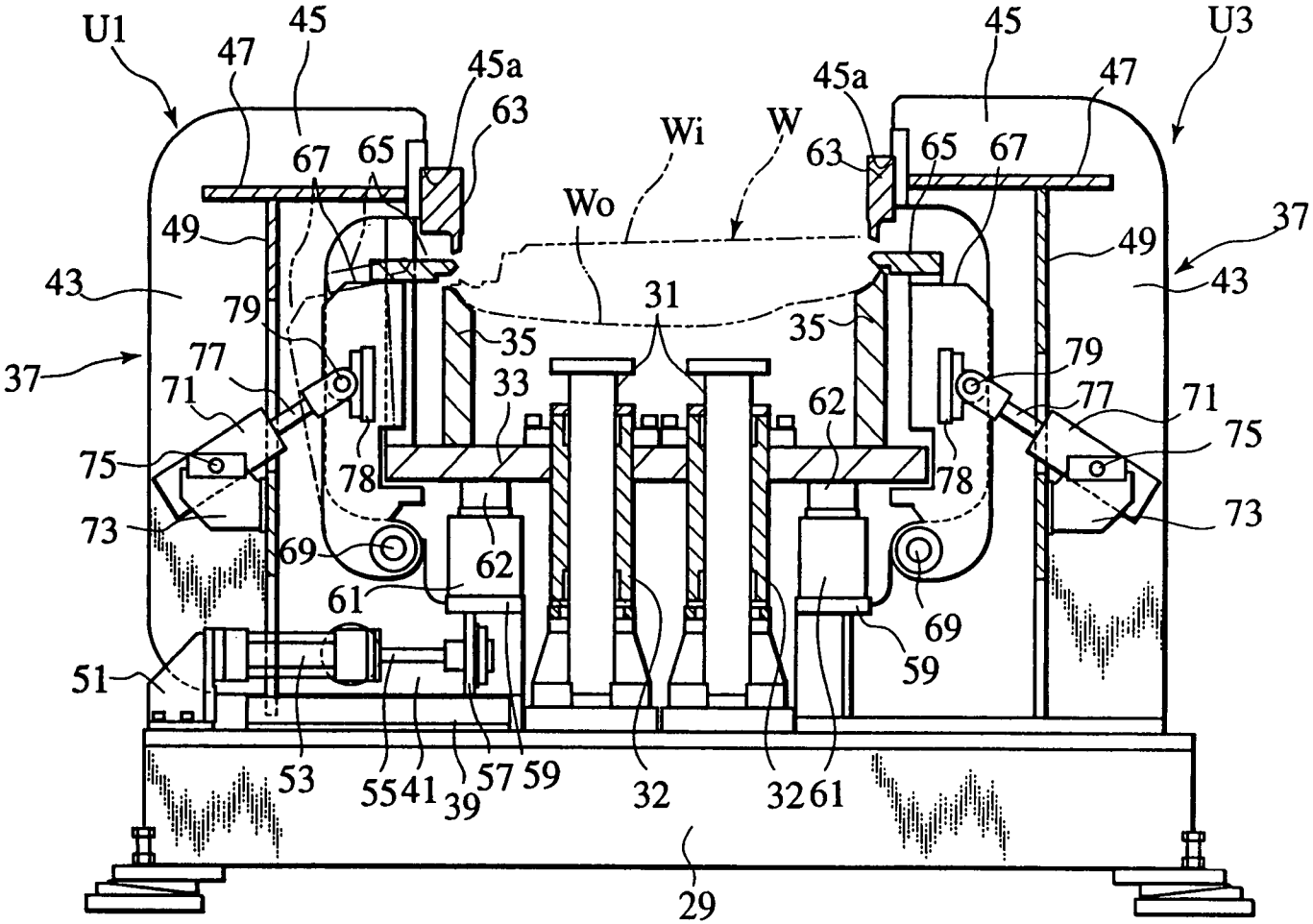
FIG. 3 is a cross-sectional view of a hemming device in one embodiment according to the present invention, which view is taken along line III—III of FIG. 4.
Figure 4:
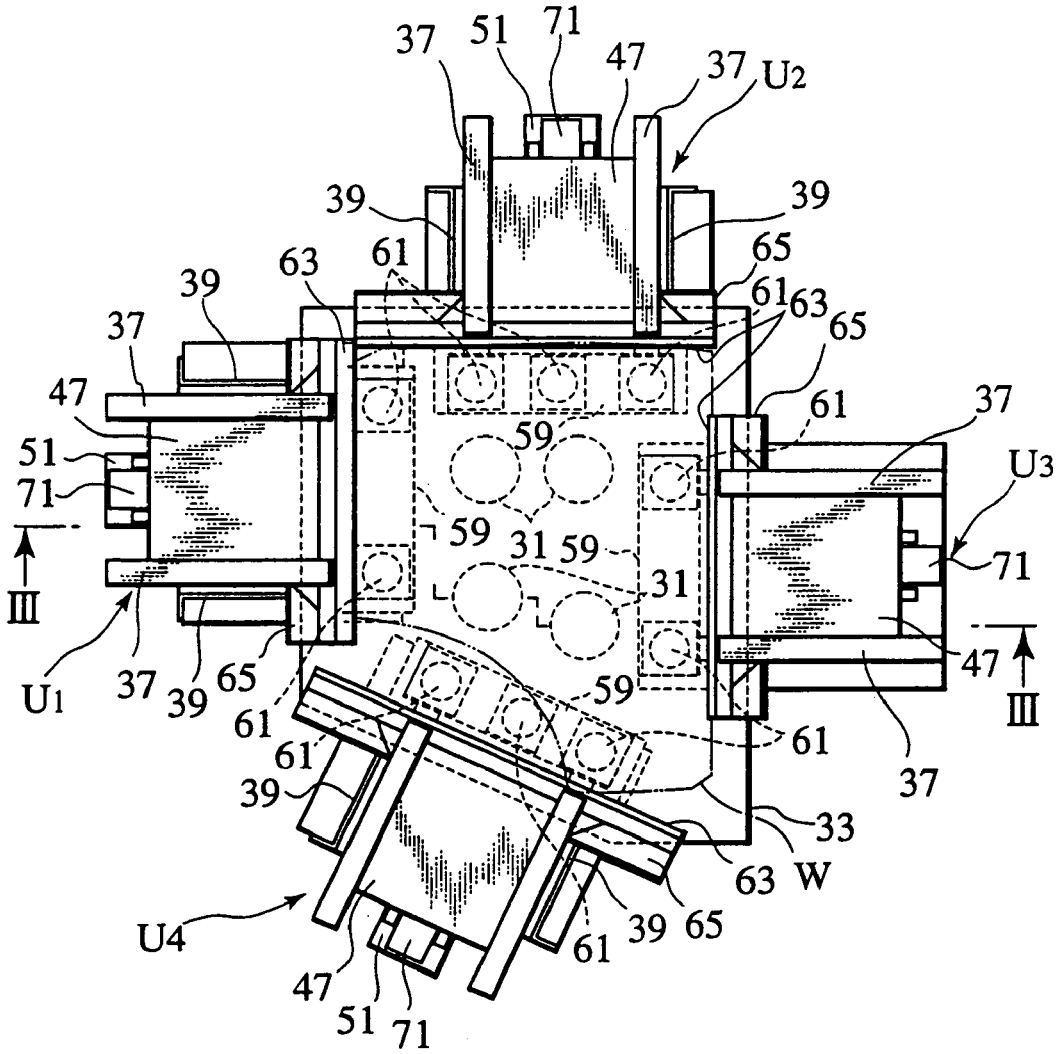
FIG. 4 is a plan view of the hemming device shown in FIG. 3.

FIG. 3 is across-sectional view taken along line III—III of FIG. 4 and shows a hemming device in one embodiment according to the present invention. FIG. 4 is a plan view of the hemming device. A workpiece W to be hemmed in this hemming device is a vehicle rear door and a so-called sash door having a window frame section formed separately from a door main body. Four working units U1, U2, U3 and U4 are responsible for hemming this workpiece W. Since these four working units U1 to U4 are the same in basic constitution, description will be given herein to the working unit U1 on the left in FIG. 3.

As shown in FIG. 3, a lifter base 33 as well as a cylindrical guide bush 32 is provided vertically movably on a plurality of lifter guides 31 disposed on a base 29. A hemming die 35 which becomes a lower die, is provided on the upper surface of the lifter base 33. The workpiece W is set on this hemming die 35 in a state in which the outer panel $W_o$ and inner panel $W_i$ of the workpiece W are assembled with each other. Here, it is assumed that the outer panel $W_o$ is put on the hemming die 35 and the inner panel $W_i$ is positioned by a positioning jig to be described later.

A C-shaped frame 37 is provided on the base 29 around the lifter base 33 to be movable to be close to and away from the hemming die 35 (laterally in FIG. 3) through a guide rail 39 The C-shaped frame 37 consists of a lower portion 41 on a guide rail 39 side, a main portion 43 extending upward from the lower portion 41 and an upper portion 45 extending right from the upper end of the main portion 43. The position of the C-shaped frame 37 shown in FIG. 3 is an advance limit position. This advance limit position corresponds to a hemming position. A position retreating left from the hemming position in FIG. 3 is a wait position.

As shown in FIG. 4, a plurality of (or two in this embodiment) C-shaped frames 37 stated above are provided per working unit. The two C-shaped frame 37 are coupled to each other by a coupling tool consisting of a horizontal plate 47 and a vertical plate 49.

A slide cylinder 53 is disposed on the base 29 between the two C-shaped frames 37 through a bracket 51. The tip end of the piston rod 55 of the slide cylinder 53 is coupled to a coupling plate 57 coupling the lower portions of the two C-shaped frames 37. That is, by driving the slide cylinder 53, the C-shaped frame 37 is slid on the base 29 along the guide rail 39.

A plurality of lifter hydraulic cylinders 61 serving as driving means are disposed on the upper surfaces of the lower portions 41 of the C-shaped frames through cylinder support plates 59 extending in a direction orthogonal to the portrait direction of the sheet of FIG. 3. The tip end of each cylinder 61 is vertically, slidably coupled to the lower portion of the lifter base 33 in FIG. 3. Namely, by driving the lifter hydraulic cylinder 61, the hemming die 35 as well as the lifter base 33 is vertically moved.

A hemming punch 63 extending in a direction orthogonal to the portrait direction of the sheet of FIG. 3 is fixed to the tip end surface, on the right in FIG. 3, of the upper portion 45 of the C-shaped frame 37 by a bolt which is not shown. A stepped portion 45*a* having a notched lower portion is formed on the tip end surface of the upper portion 45. The upper surface of the hemming punch 63 is abutted on the lower surface of this stepped portion 45*a* and the upward movement of the hemming punch 63 is thereby restricted.

A pre-hemming punch 65 for carrying out provisional hemming before final hemming by the hemming punch 63, is attached to the upper end of a swing arm 67 by a bolt not shown. The swing arms 67 are located between the two C-shaped frames 37 and two arms 67 are arranged along the direction orthogonal to the portrait direction of the sheet of FIG. 3. The lower end of each of the swing arms 67 is rotatable around a rotation support shaft 69 on the lower portion 41 of the C-shaped frame 37.

When the swing arm 67 is located at a position indicated by a solid line in FIG. 3, the pre-hemming punch 65 is in a state of provisionally hemming the workpiece W while the tip end of the pre-hemming punch 65 is between the hemming die 35 and the hemming punch 63. The position at this moment corresponds to a provisional working position. On the other hand, a position indicated by a two-dot chain line in a state in which the swing arm 67 retreats from the provisional working position is a wait position.

The rotation operation of the swing arm 67 is carried out by a swing cylinder 71 serving as swing driving means. The swing cylinder 71 is rotatably supported on a cylinder attachment bracket 73 attached to the vertical plate 49 through a rotation support shaft 75. The tip end of the piston rod 77 of the swing cylinder 71 is rotatably coupled to a coupling member 78 coupling the two swing arms 67 through a coupling shaft 79.

Figure 5:
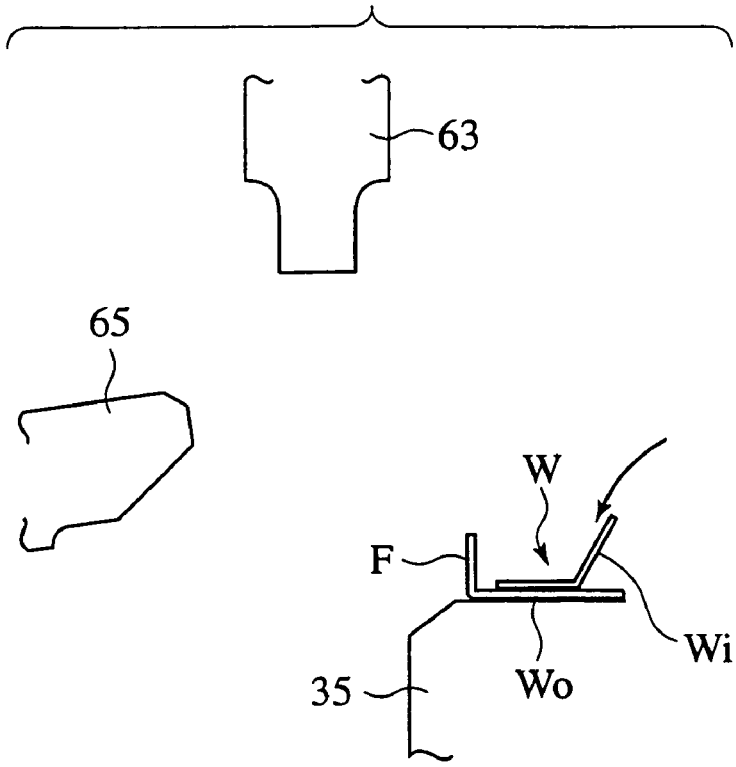
FIG. 5 is an operation explanatory view showing a state in which a workpiece is set on a hemming die in the hemming device shown in FIG. 3.

Next, the operation of the hemming device constituted as stated above will be described with reference to FIGS. 5 to 13. It is noted that the operation carried out for all working units U1 to U4 simultaneously. First, the C-shaped frame 37 is retreated from the state of FIG. 3 and put at await position and the pre-hemming punch 65 is put at await position indicated by the two-dot chain line in FIG. 3. In this state, the workpiece W is set on the hemming die 31 (FIG. 5). The workpiece setting operation can be easily conducted since the C-shaped frame 37 is at the wait position away from the hemming die 35. It is assumed that the outer peripheral edge of the outer panel $W_o$ at this moment is bent at an angle of almost 90 degrees with respect to the inner panel $W_i$ and that a flange F is formed.

As for the working unit U3 shown right in FIGS. 3 and 4, the C-shaped frame 37 is fixed to the base 29. By making the working unit U3 as well as the other working units U1, U2, U4, the C-shaped frame 37 is movable between the hemming position and the wait position, the operation for setting the workpiece W onto the die 35 can be made easier.

Figure 6:
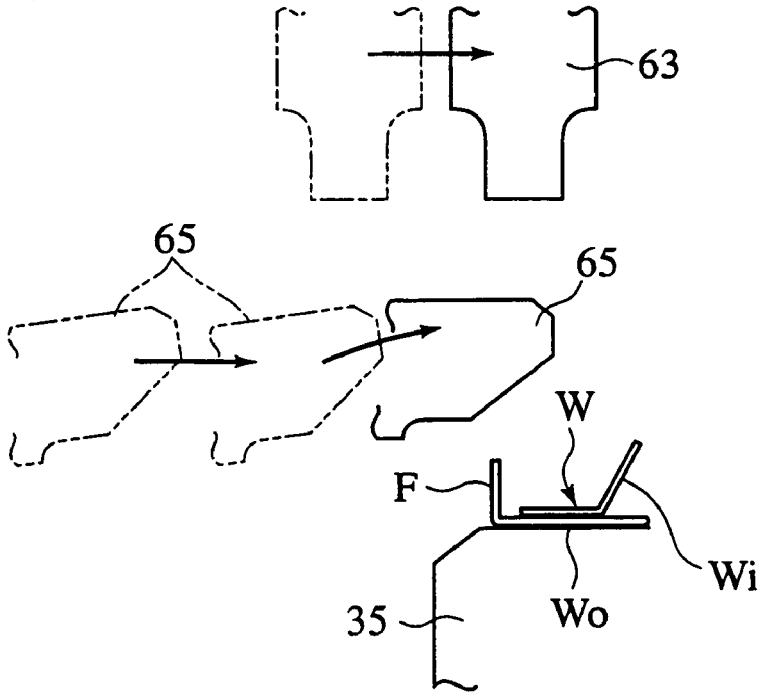
FIG. 6 is an operation explanatory view showing a state in which a C-shaped frame is advanced and then a pre-hemming punch is advanced following the state of FIG.5.

The C-shaped frame 37 is advanced from the state of FIG. 5 by the slide cylinder 53 so as to be put at the hemming position shown in FIG. 3, the hemming punch 63 is located above the hemming die 35 and the swing arm 67 is rotated by the swing cylinder 71 to thereby advance the pre-hemming punch 65 to be at the provisional working position indicated by the solid line in FIG. 3 and located above the hemming die 35 (FIG. 6).

Figure 7:
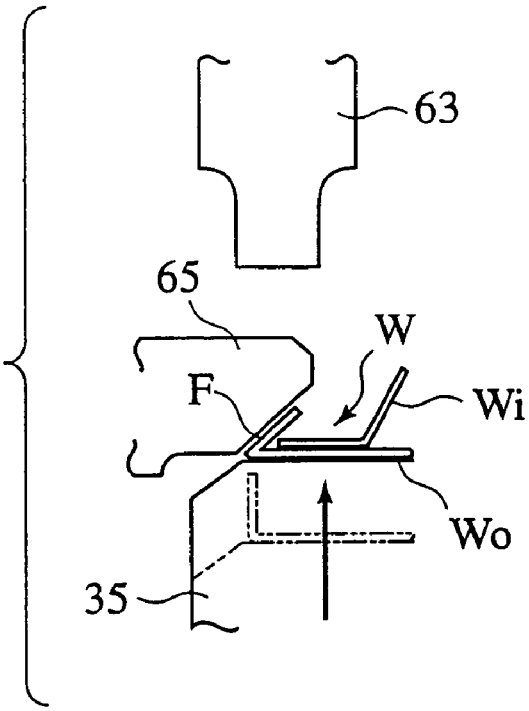
FIG. 7 is an operation explanatory view showing a state in which the hemming die is raised and provisional hemming is conducted following the state of FIG. 5.

Next, the hemming die 35 as well as the workpiece W is raised by the lifter hydraulic cylinder 61 through the lifter base 33 and the flange F of the outer panel $W_o$ is abutted on the pre-hemming punch 65, thereby carrying out provisional hemming. By doing so, the flange F is bent at about 45 degrees (FIG. 7).

At the time of carrying out the above-stated provisional hemming, the pre-hemming punch 65 approaches to the workpiece W from a horizontal direction almost at right angle with respect to the direction in which the hemming die 35 moves upward. Due to this, the approach angle of the pre-hemming punch 65 with respect to the workpiece W becomes uniform regardless of the shape of the workpiece W, so that stable working is ensured and working quality enhances. Additionally, this can facilitates the standardization of punches and reduce cost.

Figure 8:
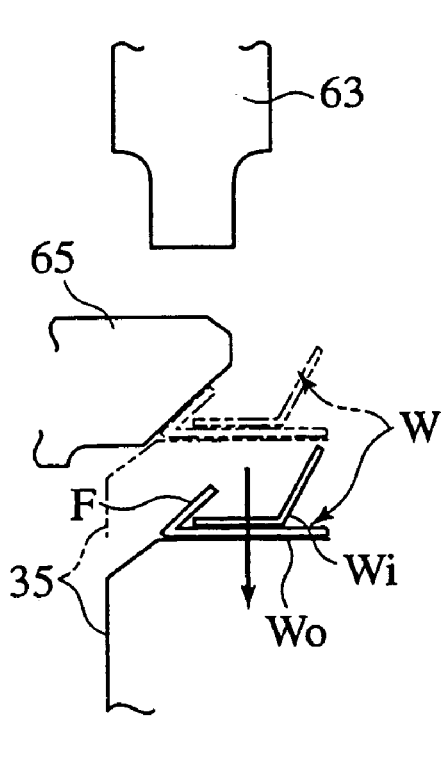
FIG. 8 is an operational explanatory view showing a state in which the hemming die is lowered following the state of FIG. 7.
Figure 9:
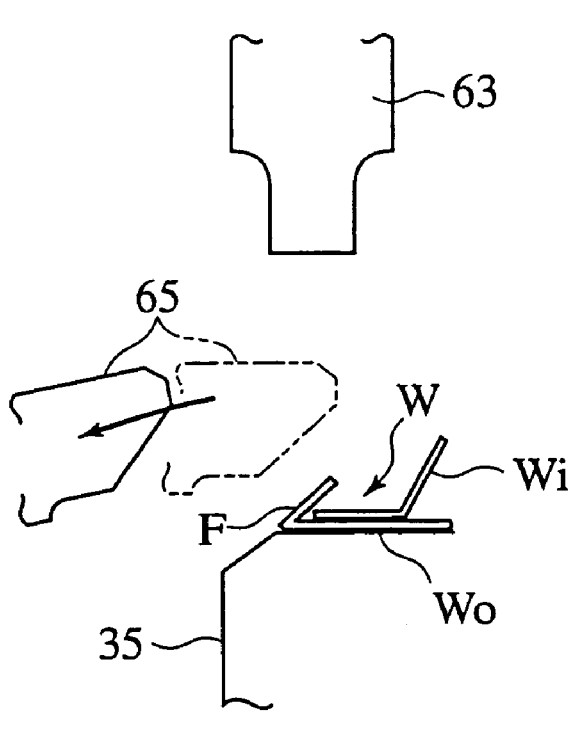
FIG. 9 is an operation explanatory view showing a state in which the pre-hemming punch is retreated following the state of FIG. 8.
Figure 10:
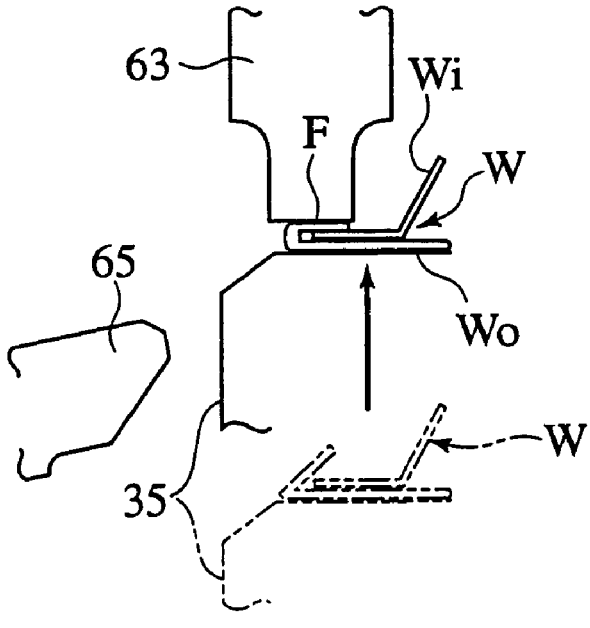
FIG. 10 is an operation explanatory view showing a state in which the hemming die is raised and final hemming is conducted following the state of FIG. 9.

Next, the hemming die 35 as well as the workpiece W is lowered by the lifter hydraulic cylinder 61 (FIG. 8) and then the pre-hemming punch 65 is retreated by the swing cylinder 71 to the wait position (FIG. 9). Thereafter, the hemming die 35 is raised by the lifter hydraulic cylinder 61, the flange F which is provisionally worked to be bent at about 45 degrees is abutted on the hemming punch 63, thereby completing final hemming (FIG. 10).

Figure 12:
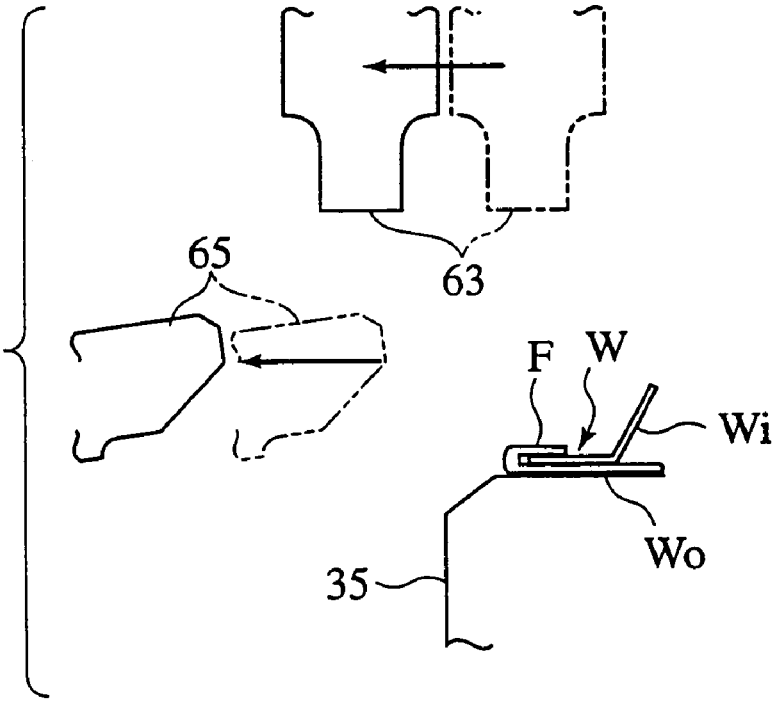
FIG. 12 is an operation explanatory view showing a state in which the C-shaped frame is retreated following the state of FIG. 11; of FIG. 11.
Figure 13:
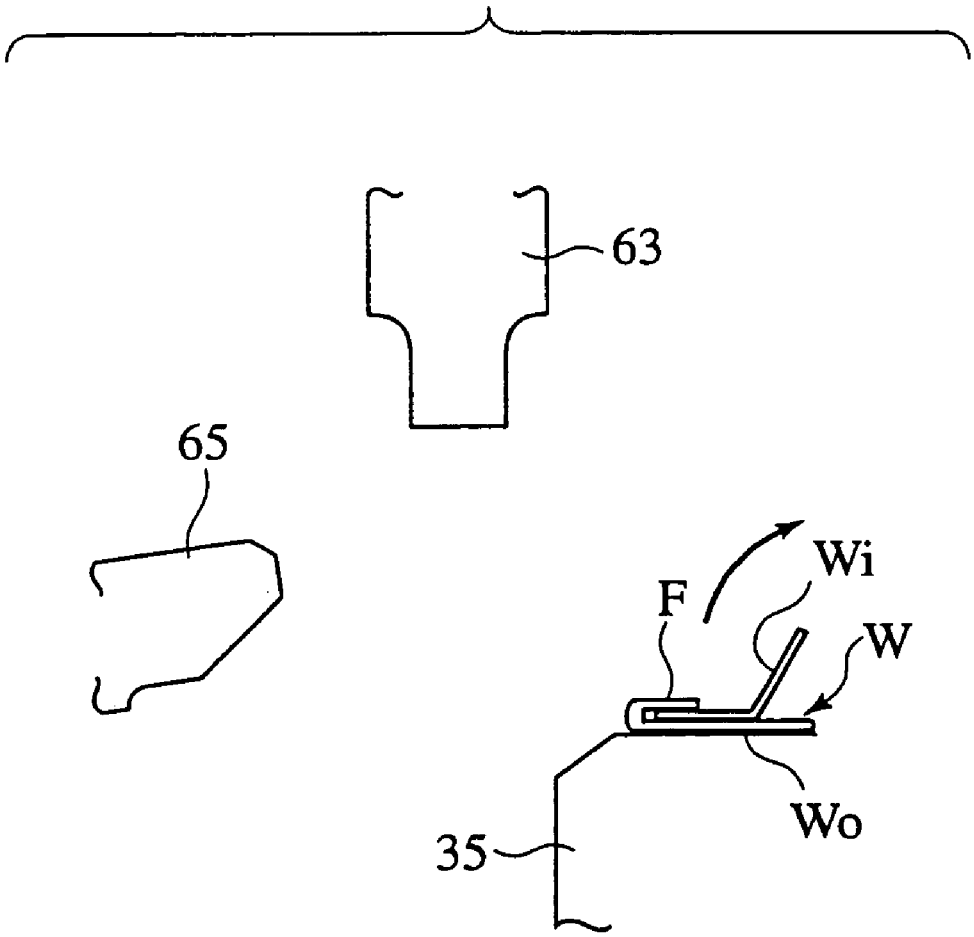
FIG. 13 is an operation explanatory view showing a state in which the workpiece is taken out following the state of FIG. 12.

At this moment, by raising the hemming die 35, the workpiece is hemmed between the raised hemming die 35 and the hemming punch 63 attached to the C-shaped frame 37 above the hemming die 35. Hemming pressure is received in the C-shaped frame 37 and the base 29 is not applied with overload. Thus, it is not necessary to increase the rigidity of the base 29 side and it is, therefore, possible to prevent the overall device from becoming large in size Thereafter, the hemming die 35 is lowered back to its original position (FIG. 11), the C-shaped frame 37 is retreated to the wait position (FIG. 12) and the workpiece W is taken out (FIG. 13).

According to the hemming device described above, both the pre-hemming punch 65 and the hemming punch 63 wait upward during the hemming and the hemming die 35 directly moves upward relative to the waiting punches 65 and 63 and the hemming is carried out. Therefore, even if the adjacent working units U1 to U4 operate simultaneously, the units do not interfere with one another and the provisional hemming and the final hemming can be carried out in succession at a short stroke. This can reduce the cycle time of the working operation. Besides, since the hemming device is a direct moving type in which the hemming die 35 is raised, it is possible to easily set hemming pressure at right angle to the surface of the workpiece W and the approach angle of the pre-hemming punch 65 to the workpiece W is lateral. This can facilitate standardizing working units and realize cost reduction.

Moreover, the lifter hydraulic cylinder 61 is raised almost under a to-be-hemmed region of the workpiece W. Due to this, it is possible to efficiently apply hemming pressure to the workpiece W. To hem the corners of the workpiece W, adjacent units U1 and U2 in FIG. 4, for example, can be used for the hemming. This can dispense with a corner dedicated working unit, reduce the number of working units accordingly and reduce cost.

Furthermore, by appropriately changing the number of lifter hydraulic cylinders 61 for one working unit, hemming pressure can be changed. This can dispense with a device such as a pressure conversion device and simplify the hydraulic devices.

The swing arm 67 and the slide cylinder 71 for moving the pre-hemming punch 65 in this embodiment between the provisional working position and the wait position may be replaced by a slide member sliding in horizontal direction relative to the C-shaped frame 37 in FIG. 3 and slide driving means for driving the slide member, and the slide member and the slide driving means may be provided at the C-shaped frame 37.

Further, to hem a region in which a window frame portion is attached to the workpiece W or a so-called waist portion (an edge portion on the right in FIGS. 3 and 4), it is necessary to bend the outer panel $W_o$ relative to the end portion of a reinforcement, not shown, interposed between the outer panel $W_o$ and the inner panel $W_i$ and to form a gap, into which a window glass enters, between the bent outer panel $W_o$ and the inner panel $W_i$. In this case, therefore, the end portion of the inner panel $W_i$ on the right in FIGS. 3 and 4 is set at a position at which the end portion does not interfere with the hemming punch 63.

Second Embodiment

Figure 14:
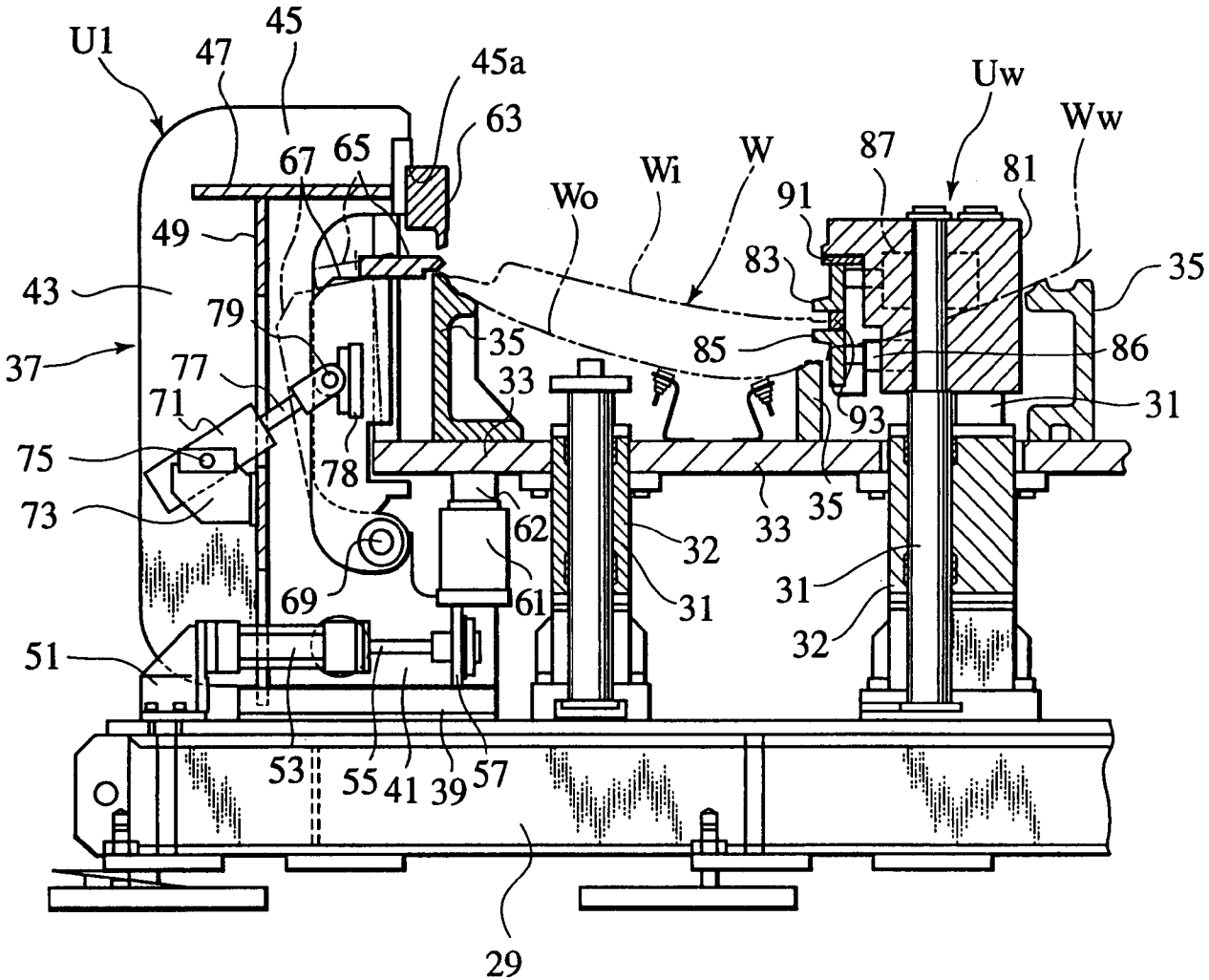
FIG. 14 is a cross-sectional view of a hemming device in another embodiment according to the present invention, which view is taken along line XIV—XIV of FIG. 15.
Figure 15:
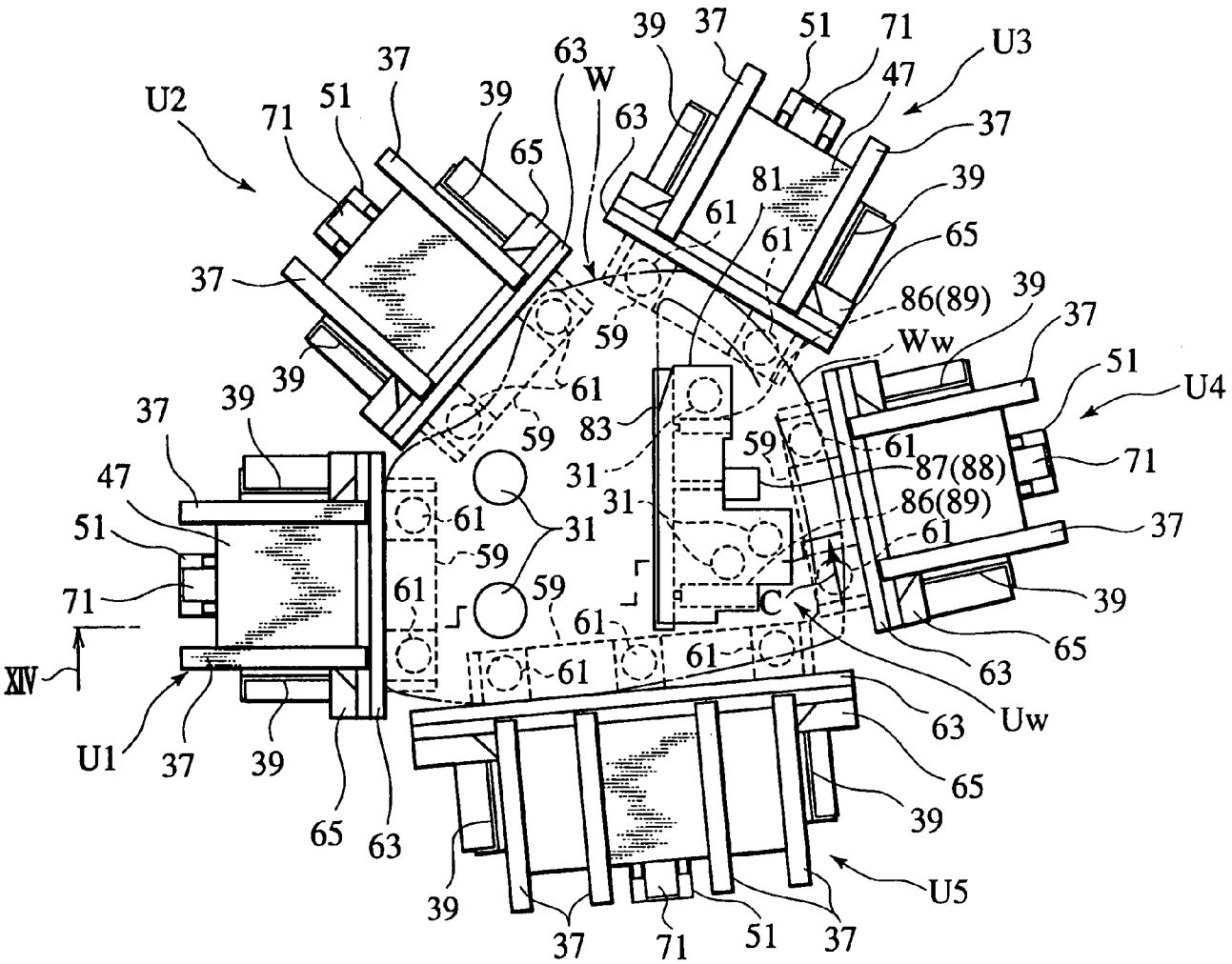
FIG. 15 is a plan view of the hemming device shown in FIG. 14.

FIG. 14 is a cross-sectional view of a hemming device in another embodiment according to the present invention, taken along line XIV—XIV shown in FIG. 15. FIG. 15 is a plan view of the hemming device. A workpiece W to be hemmed in this hemming device is an automobile rear door or a so-called full door having a window frame portion $W_w$ formed integrally with an outer panel $W_o$ which become a door main body.

In this embodiment, a working unit $U_w$ for hemming the waist portion stated above and positioned in the window frame of the full door. It is noted, however, five working units similar to the working units U1 to U4 shown in FIG. 4 for hemming the outer peripheral portion of the workpiece W are also provided.

Figure 16:
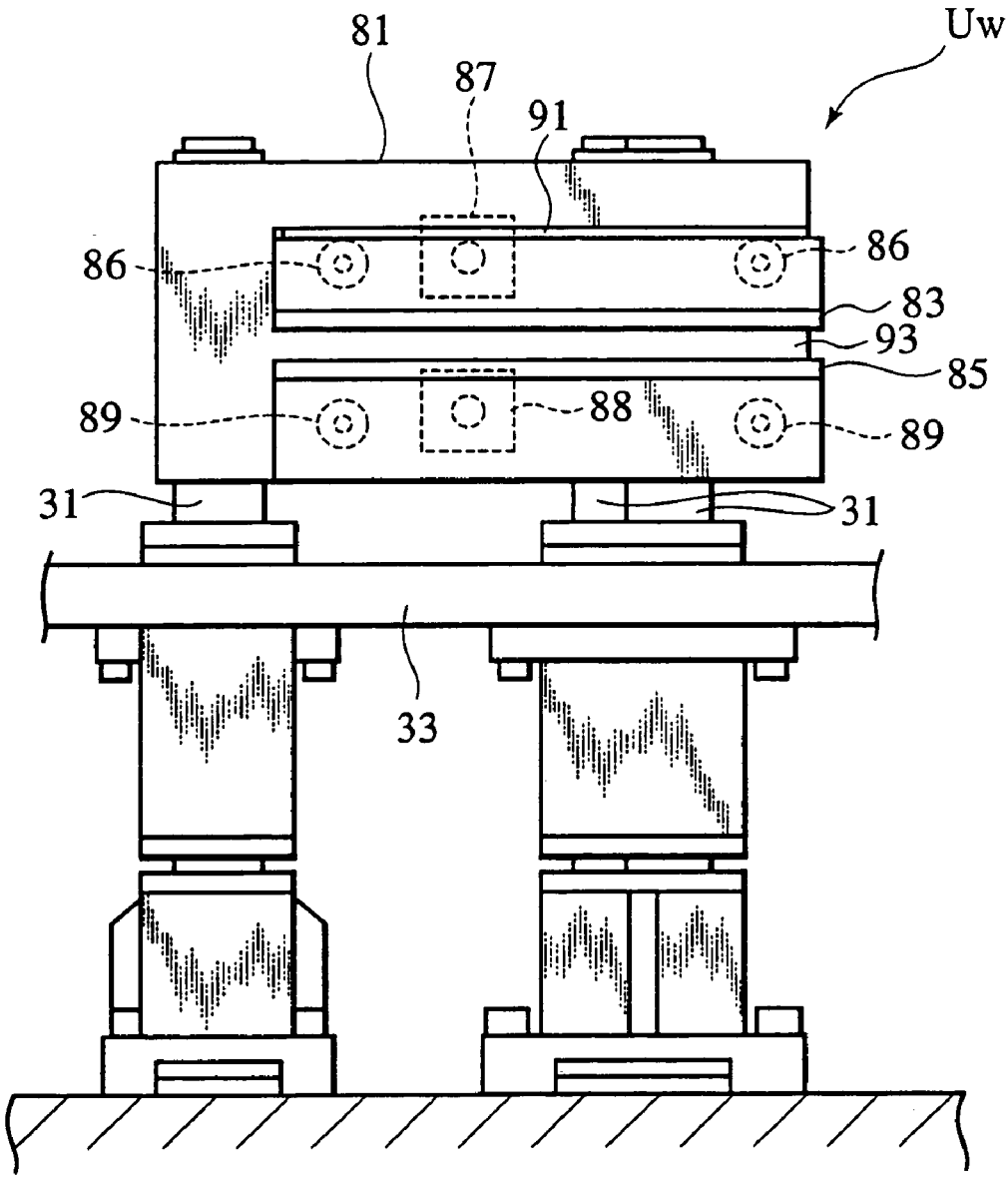
FIG. 16 is a left side view of a working unit of the hemming device shown in FIG. 14.

The working unit $U_w$ is provided on the upper end of a portion of a lifter guide 31 vertically guiding a lifter base 33, which portion protrudes upward from the lifter base 33. Here, as shown in FIG. 15, a waist hemming bracket 81 for the working unit $U_w$ is fixed to the upper end of the three lifter guides 31. The waist hemming bracket 81 is set to have such a size as to enter the interior of the window frame $W_w$ of the workpiece W. FIG. 16 is a left side view of the working unit $U_w$ provided on the upper end of the lifter guides 31 shown in FIG. 14.

The waist hemming bracket 81 is provided with the second hemming punch 83 and the second pre-hemming punch 85 both of which punches are movable in the lateral direction in FIG. 14. The second hemming punch 83 is moved between a hemming position located above the hemming die 35 shown in FIG. 14 and a wait position retreated right from the hemming position in FIG. 14 by a hemming cylinder 89 attached to the waist hemming bracket 81 and two guide shafts 86. The second pre-hemming punch 85 is moved between a pre-hemming position located above the hemming die 35 shown in FIG. 14 and a wait position retreated right from the pre-hemming position in FIG. 14 by a pre-hemming cylinder 88 and two guide shifts 89 attached to the waist hemming bracket 81 and arranged along the direction orthogonal to the portrait direction of the sheet of FIG. 14.

Also, a shim 91 for allowing the waist hemming bracket 81 to receive hemming pressure is provided on the lower surface of the waist hemming bracket 81 above the second hemming punch 83. A shim 93 for allowing the waist hemming bracket 81 to receive hemming pressure through the hemming punch 83 is provided on the upper surface of the second pre-hemming punch 85.

Next, the operation of the hemming device constituted as stated above will be described with reference to FIGS. 17 to 26 illustrating the operation of the working unit $U_w$ as well as FIGS. 14 to 16. It is assumed that the operation is carried out for all the working units U1 to U5 and $U_w$. The operations of the working units U1 to U5 are the same as the working units U1 to U4 in the first embodiment shown in FIG. 3. In FIGS. 17 to 26, reinforcement $W_r$ interposed between the outer panel $W_o$ and the inner panel $W_i$ is shown.

Figure 17:
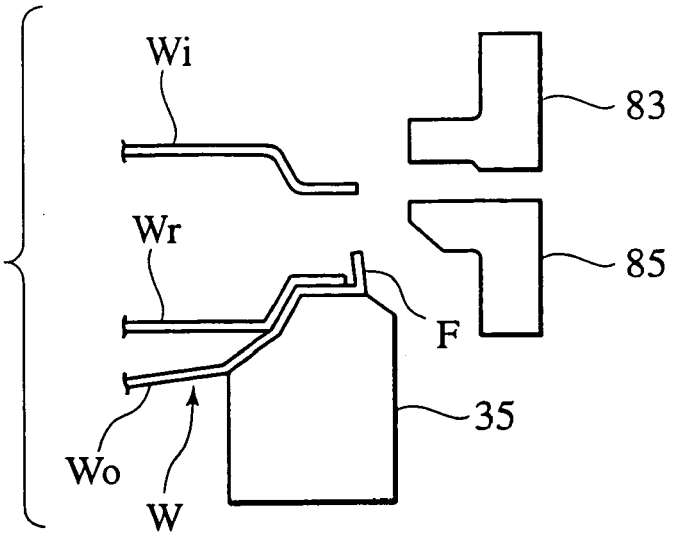
FIG. 17 is an operation explanatory view showing a state in which a workpiece is set on a hemming die in the hemming device shown in FIG. 14.
Figure 18:
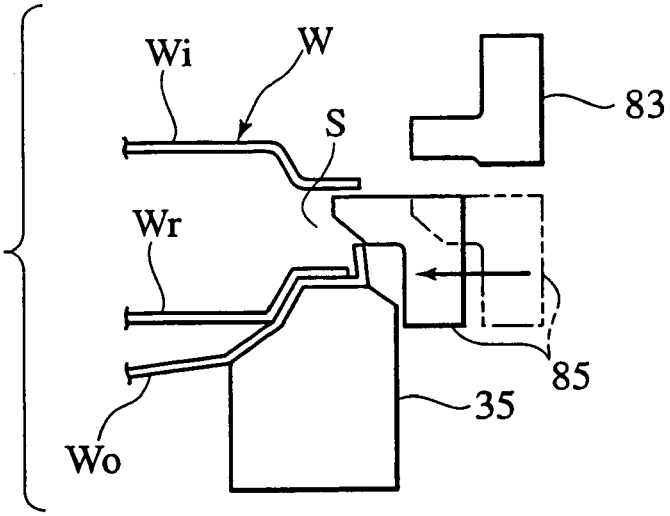
FIG. 18 is an operation explanatory view showing a state in which a C-shaped frame is advances and then the second pre-hemming punch is advanced following the state of FIG. 17.

FIG. 17 shows a state in which the workpiece W has been set onto the hemming die 35 which state corresponds to that shown in FIG. 5. In this case, both the second hemming punch 83 and the second pre-hemming punch 85 retreat to their wait positions, thereby facilitating setting the workpiece W onto the hemming die 35. In this state, the C-shaped frame 37 is working units U1 to U5 are put in the state shown in FIG. 16. At the same time, the pre-hemming cylinder 88 is actuated to advance the second pre-hemming punch 85 to the pre-hemming position and be located above the hemming die 35 (FIG. 18). At this moment, the second pre-hemming punch 85 enters a space S between the outer panel $W_o$ and the inner panel $W_i$.

Figure 19:
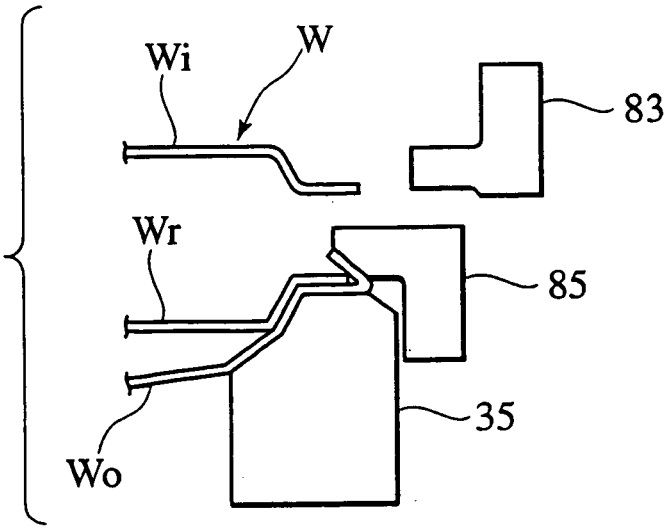
FIG. 19 is an operation explanatory view showing a state in which the hemming die is raised and provisional hemming is conducted following the state of FIG. 18.

Next, the hemming die 35 as well as the workpiece W is raised by the lifter hydraulic cylinder 61 through the lifter base 33, thereby carrying out provisional hemming shown in FIG. 7. At the same time, the flange F of the outer panel $W_o$ is abutted on the second pre-hemming punch 83, thereby carrying out provisional hemming (FIG. 19). By doing so, the flange F on the waist portion as well as the outer peripheral portion of the workpiece W is bent at about 45 degrees.

Figure 20:
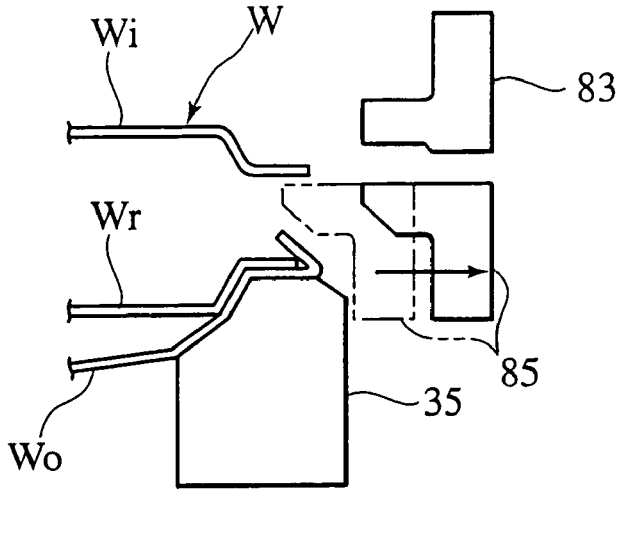
FIG. 20 is an operation explanatory view showing a state in which the hemming die is lowered and the second pre-hemming die is retreated following the state of FIG. 19.

Thereafter, the hemming die 35 as well as the workpiece W is lowered by the lifter hydraulic cylinder 61 as show in FIG. 8. Then, the pre-hemming punch 65 is retreated as shown in FIG. 9 and the second pre-hemming punch 85 is retreated to the wait position by the swing cylinder 71 (FIG. 20). The hemming die 35 is raised by the lifter hydraulic cylinder 61. In this embodiment, the hemming die 35 is raised up to an intermediate position so that the second hemming punch 83 can enter the space S, not shown, which is formed between the outer panel $W_o$ and the inner panel $W_i$ and into which a window glass is inserted (FIG. 21).

Figure 22:
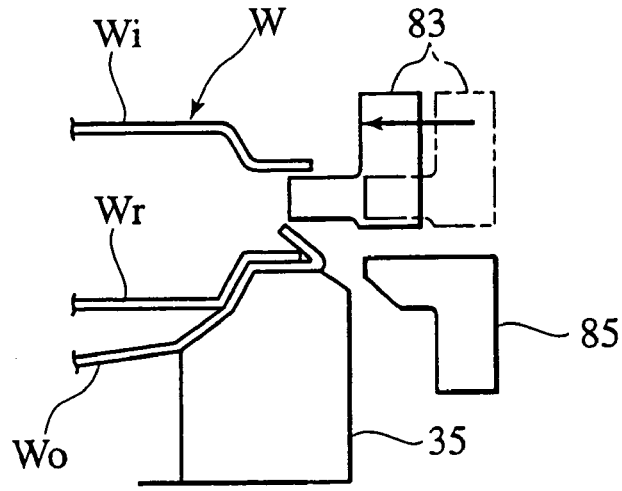
FIG. 22 is an operation explanatory view showing a state in which the second hemming punch is advanced following the state of FIG. 21.
Figure 23:
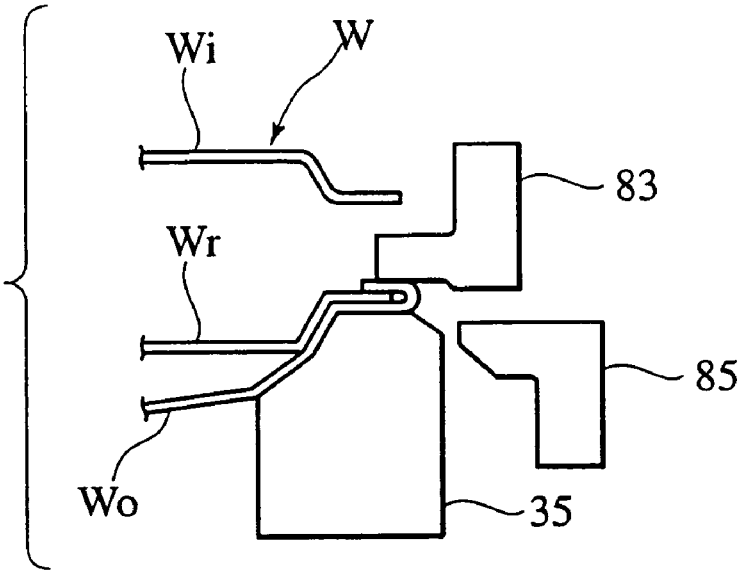
FIG. 23 is an operation explanatory view showing a state in which the hemming die is raised and final hemming is conducted following the state of FIG. 22.

In this state, the hemming cylinder 87 is actuated to advance the second hemming punch 83 from the wait position to the hemming position (FIG. 22). The flange F provisionally worked to be bent at about 45 degrees as shown in FIG. 10 is abutted on the hemming punch 63, thereby carrying out final hemming. At the same time, the hemming die 35 is raised to abut the flange F provisionally worked to be bent at about 45 degrees is abutted on the second hemming punch 83 and to superpose the flange F on the end portion of the reinforcement $W_r$, thereby completing final hemming (FIG. 23).

Figure 11:
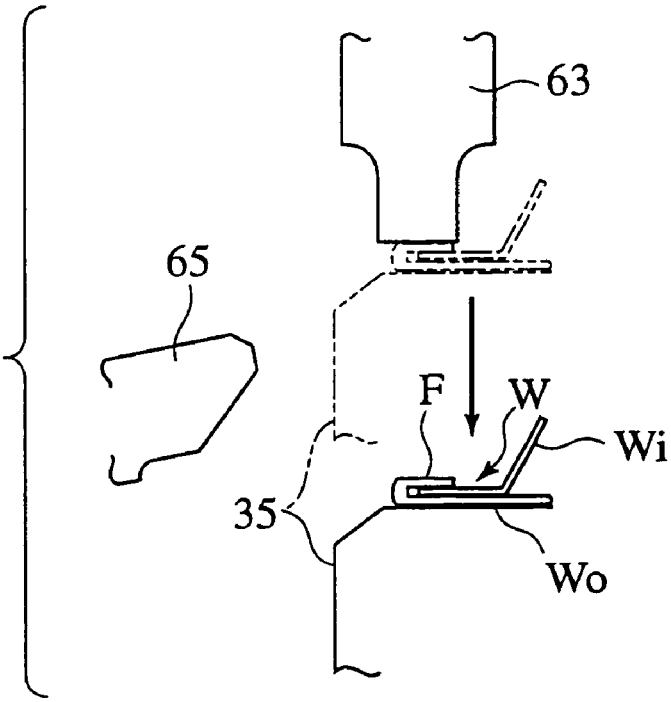
FIG. 11 is an operation explanatory view showing a state in which the hemming die is lowered to its original position following the state of FIG. 10.
Figure 21:
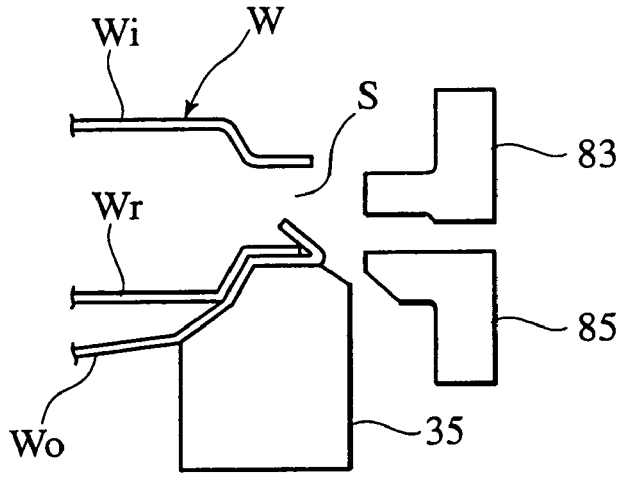
FIG. 21 is an operation explanatory view showing a state in which the hemming die is raised up to an intermediate position following the state of FIG. 20.
Figure 24:
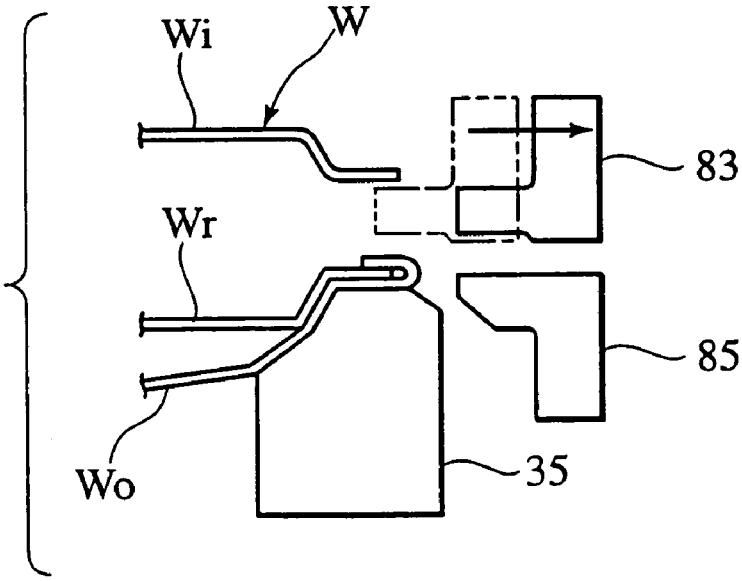
FIG. 24 is an operation explanatory view showing a state in which the hemming die is lowered to the intermediate position and the second hemming punch is lowered following the state of FIG. 23.
Figure 25:
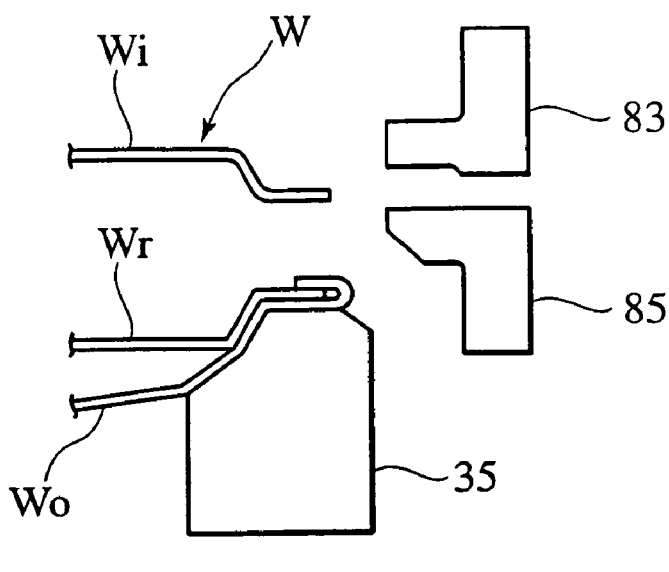
FIG. 25 is an operation explanatory view showing a state in which the hemming die is lowered to its original position following the state of FIG. 24.
Figure 26:
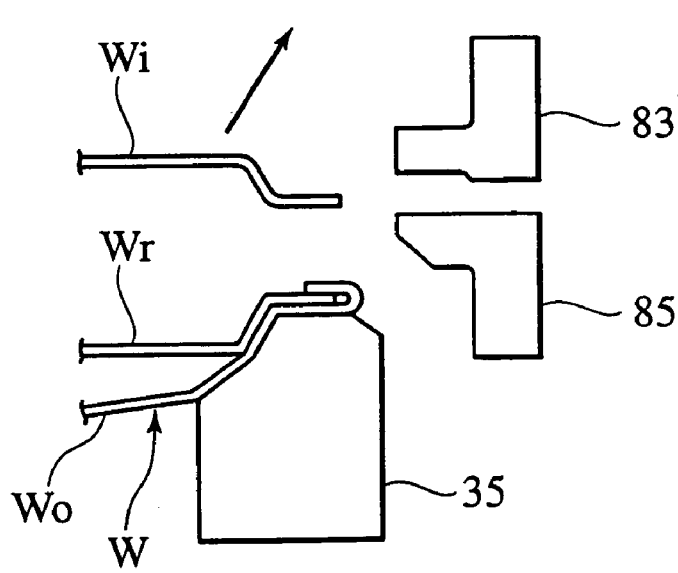
FIG. 26 is an operation explanatory view showing a state in which the C-type frame is retreated to a wait position and a workpiece is taken out following the state of FIG. 25.

The hemming die 35 is lowered to the intermediate position shown in FIG. 21 and the second hemming punch 83 is retreated to the wait position (FIG. 24). Thereafter, the operation shown in FIG. 11 is carried out, i.e., the hemming die 35 is lowered to its original position (FIG. 25). The operation shown in FIG. 12 is carried out, i.e., the C-shaped frame 37 is retreated to the wait position. Thereafter, as in the case of FIG. 13, the workpiece W is taken out (FIG. 26).

According to the above-stated hemming device, the working unit $U_w$ provided with the second hemming punch 83 and the second pre-hemming punch 85 is disposed on the portion of the lifter guide 31 protruding above the lifter base 33. Due to this, it is possible to set the workpiece W so that the working unit $U_w$ is located in the window frame $W_w$ of the workpiece W consisting of the rear door. As a result, the hemming by the working unit $U_w$ from the inside of the window frame $W_w$ to the waist portion of the workpiece W can be carried out simultaneously with the hemming by the working units U1 to U5 to the outer peripheral portion of the workpiece W. It, therefore, becomes unnecessary to carry out the hemming starting at the inside of the window frame $W_w$ by a separate step, making it possible to reduce working time and facility cost.

Third Embodiment

Figure 27:
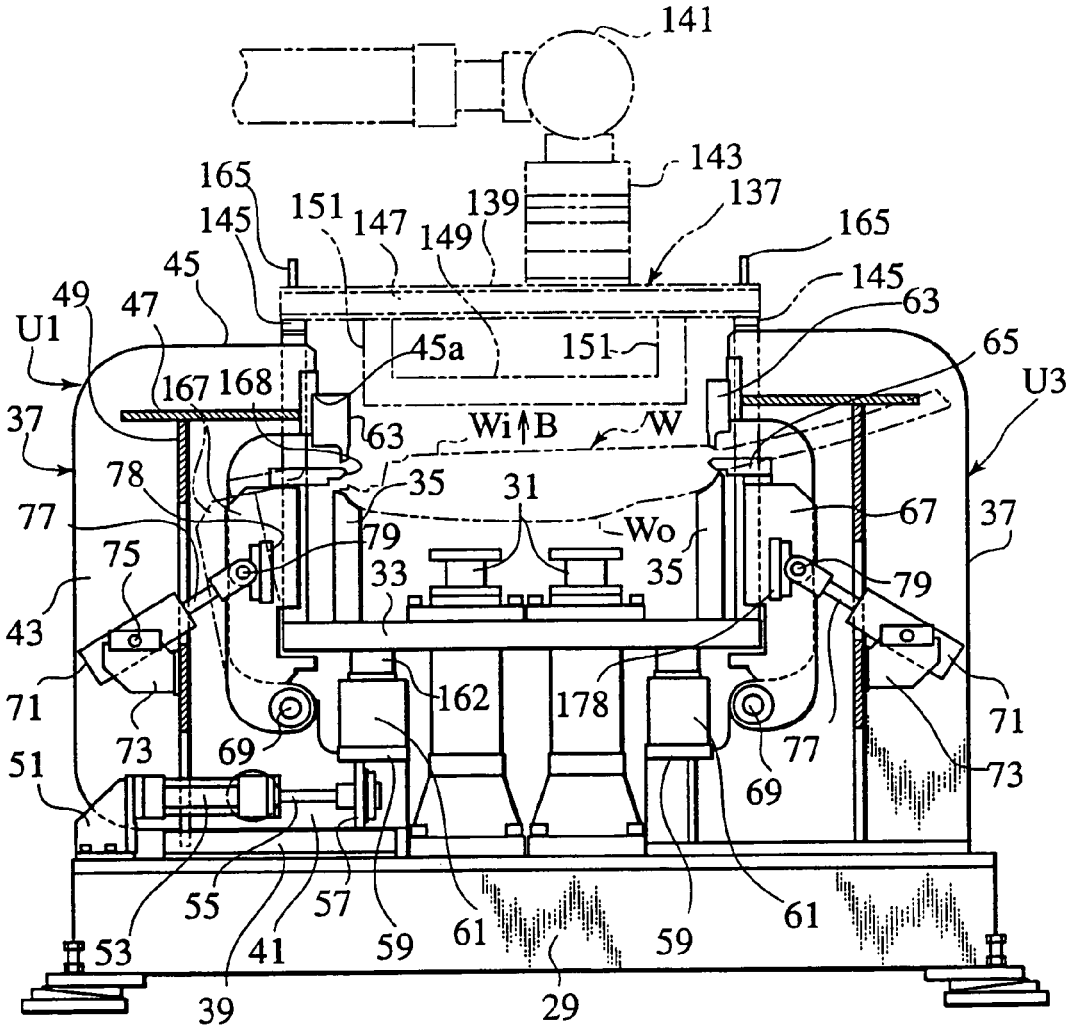
FIG. 27 is a cross-sectional view of a hemming device in yet another embodiment according to the present invention.
Figure 28:
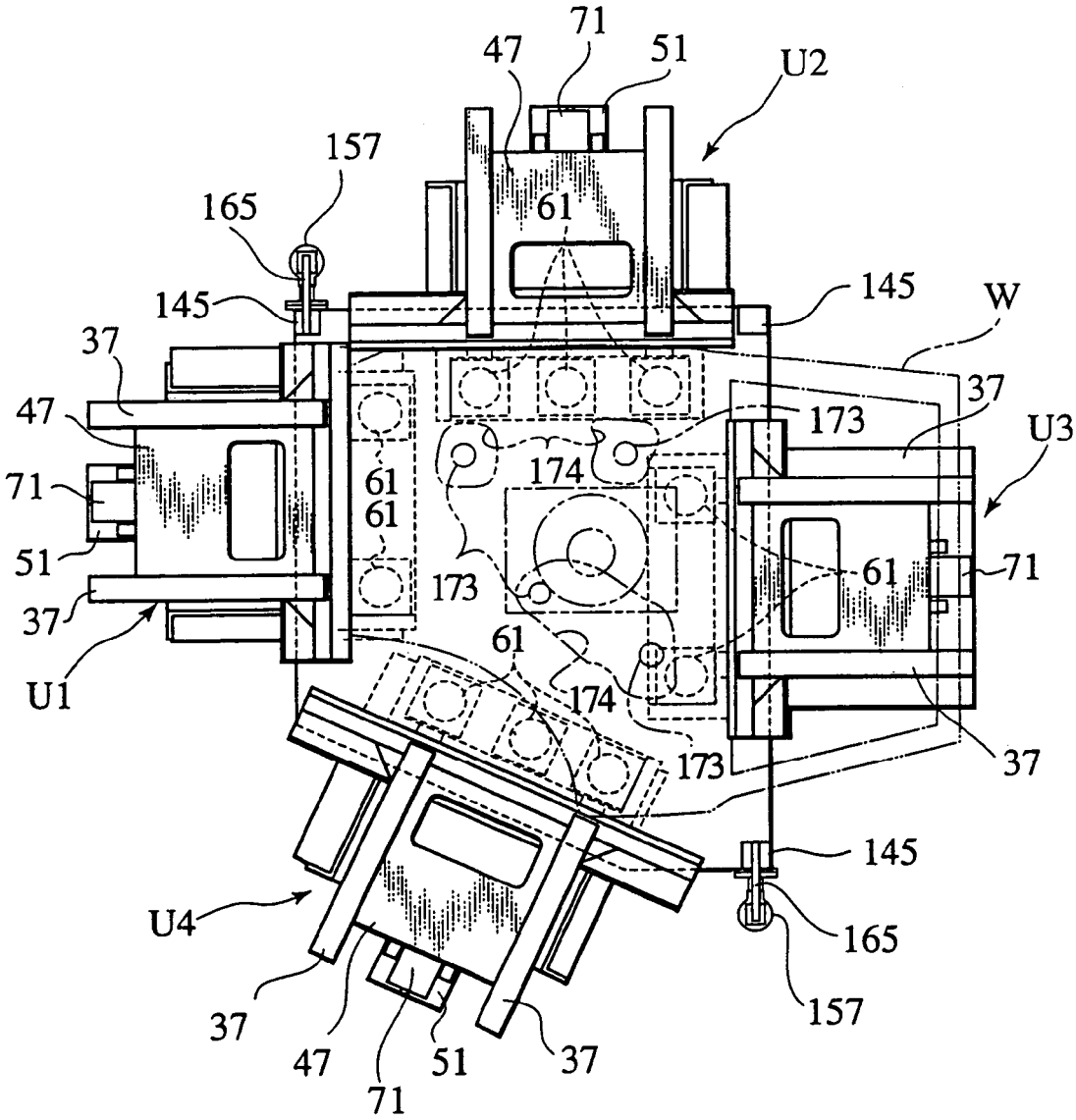
FIG. 28 is a plan view of the hemming device shown in FIG. 27.

FIG. 27 is a side cross-sectional view of a hemming device in yet another embodiment according to the present invention. FIG. 28 is a plan view of the hemming device. A workpiece W to be hemmed in this hemming device is a vehicle rear door. As in the case of the first embodiment, the periphery of the workpiece W is hemmed by four working units U1, U2, U3 and U4.

As shown in FIG. 27, a lifter guide 31 disposed on a base 29 is provided with a lifter base 33 which is vertically movable. A hemming die 35 which becomes a lower die is disposed on the upper surface of the lifter base 33. The workpiece W is set onto the hemming die 35 while being positioned and gripped by a workpiece grip hand 137 in a state in which an outer panel $W_o$ is put below an inner panel $W_i$ and the outer panel $W_o$ and the inner panel $W_i$ are assembled with each other in advance.

Figure 29:
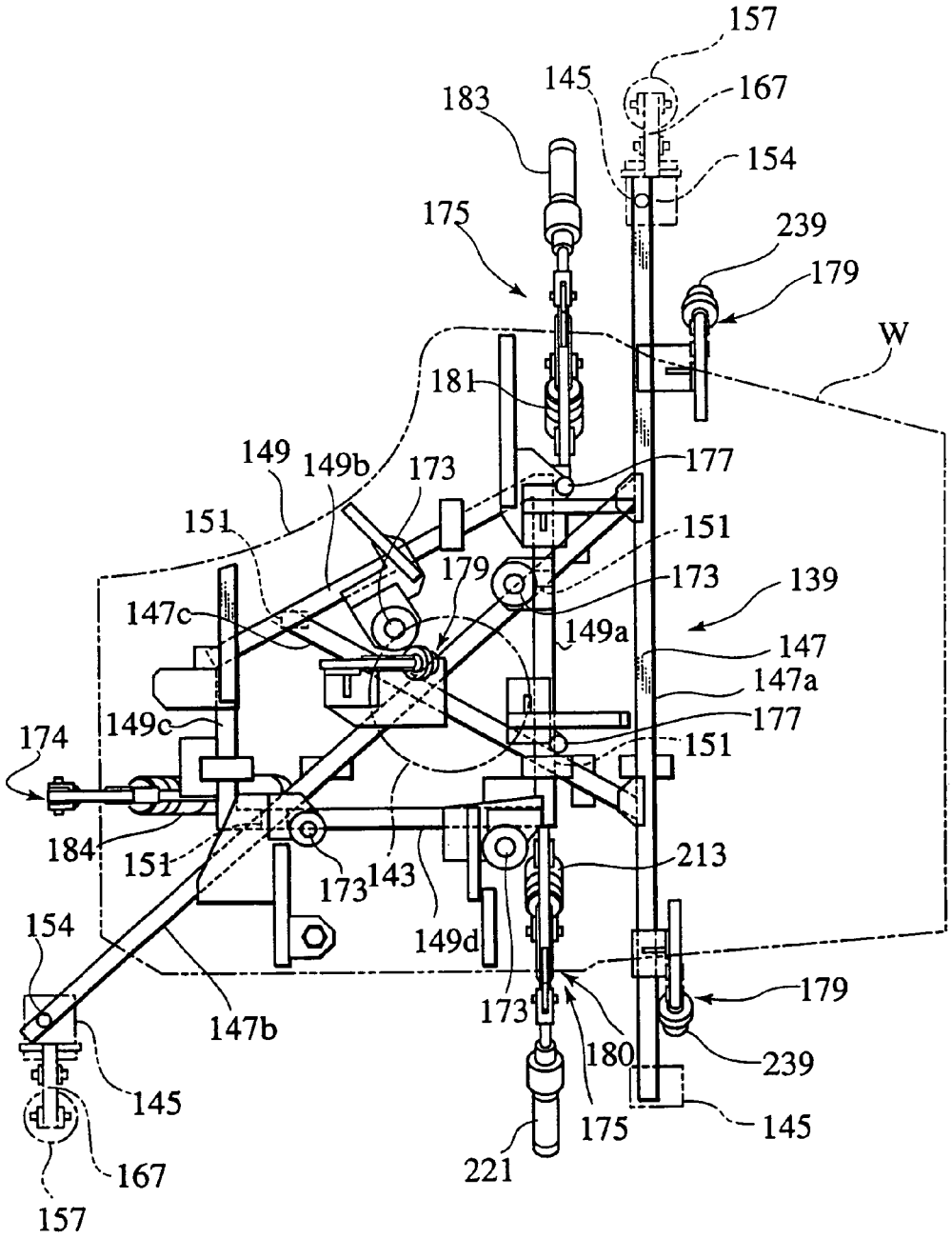
FIG. 29 is a perspective view seen from B of FIG. 27.

It is noted that only the frame 139 of the workpiece grip hand 137 is shown in FIG. 27 and a mechanism, attached to this frame 139, for positioning and gripping the workpiece W is not shown therein. The detail of the workpiece grip hand 138 provided with the positioning and grip mechanism is shown in FIG. 29 which is a perspective view seen from B of FIG. 27, FIG. 30 which is a left side view of FIG. 29, and FIG. 31 which is a top view of FIG. 29. This workpiece grip hand 137 is detachably held by a robot 141 serving as hand transport means through a hand changer 143 and transported together with the workpiece W by this robot 141.

Three hand mounting posts 145 serving as hand mounts are provided on the lifter base 33 shown in FIG. 27 externally of the hemming die 35. The workpiece grip hand 137 is transported by the robot 141 while being held by the robot 141, and positioned and mounted on the hand mounting posts 145.

Figure 30:
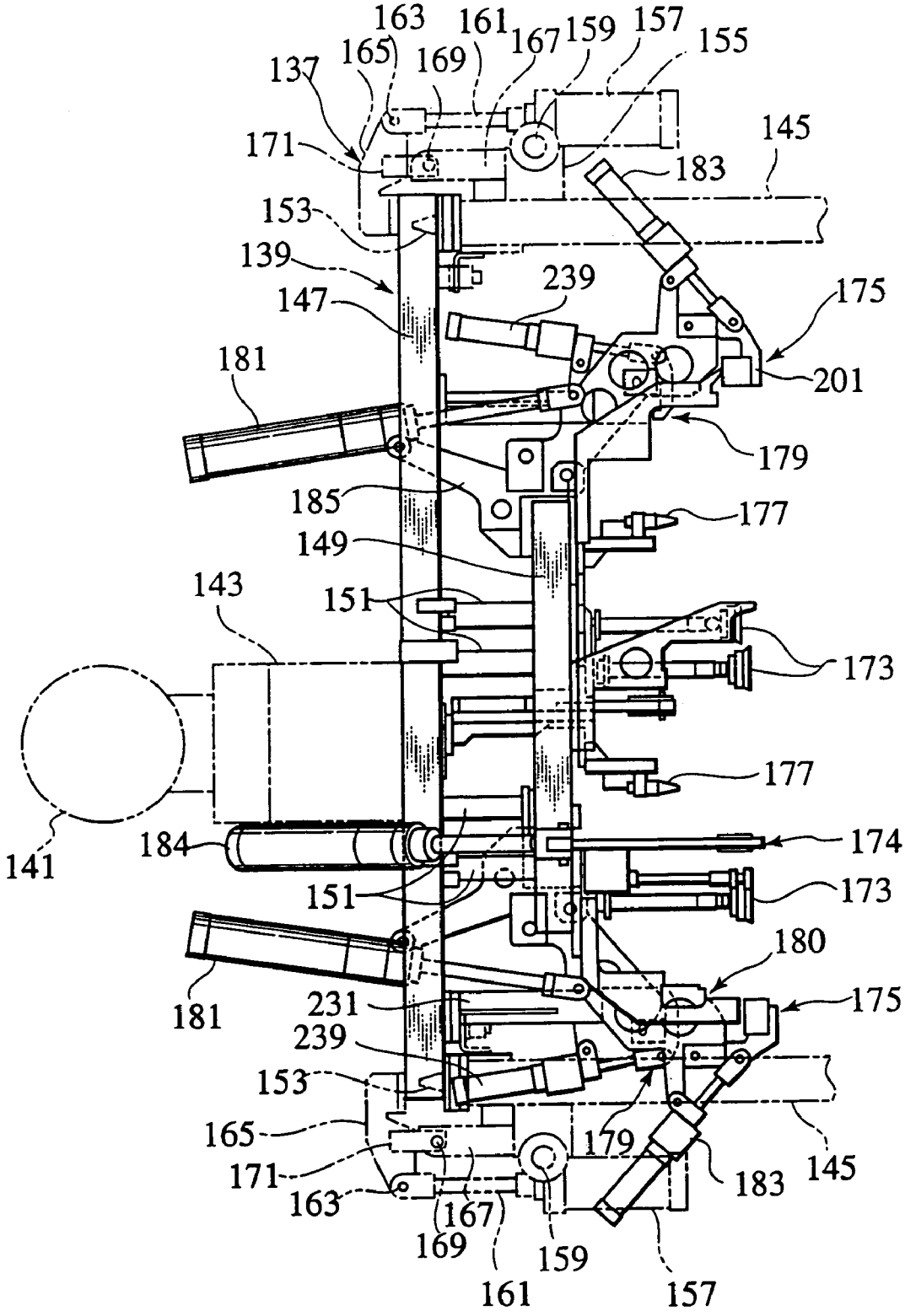
FIG. 30 is a left side view of FIG. 29.
Figure 31:
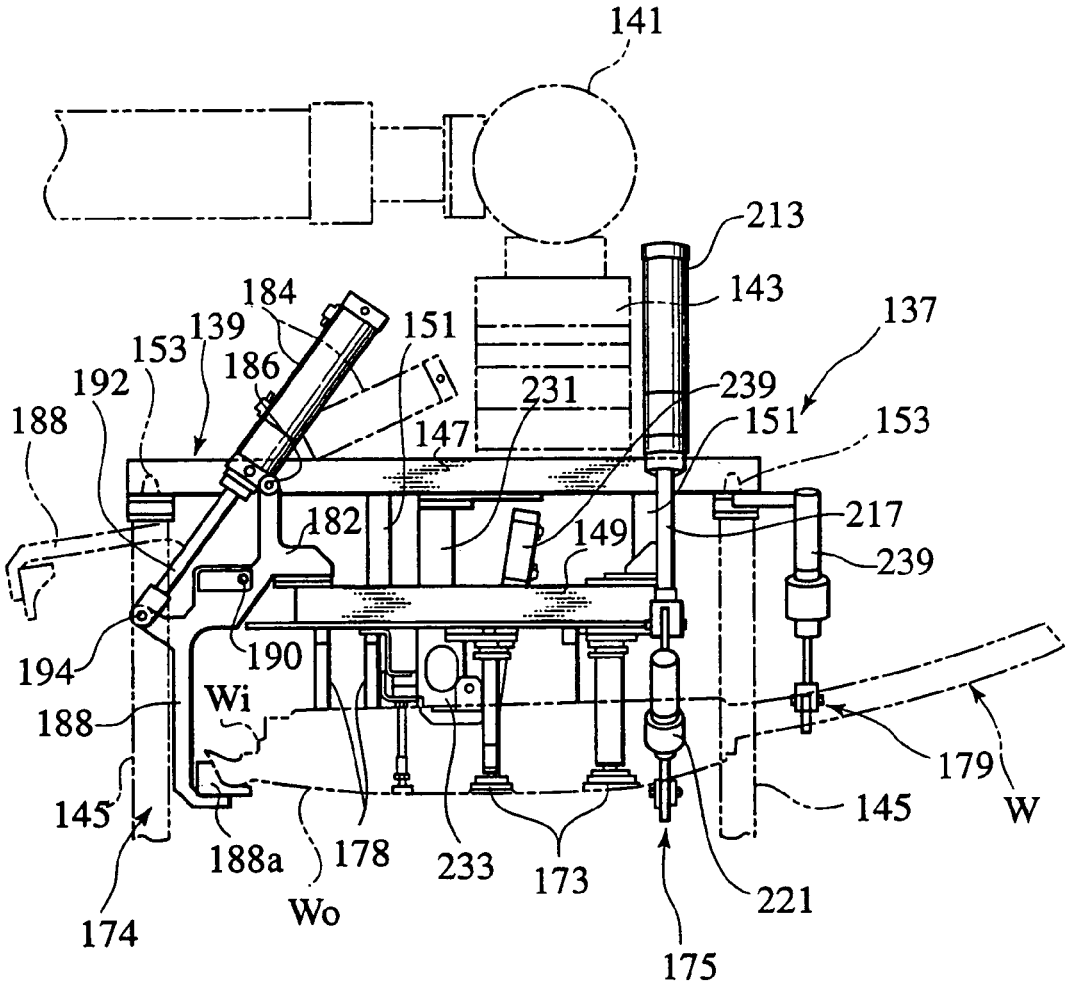
FIG. 31 is a top view of FIG. 29.

The frame 139 of the workpiece grip hand 137 is constituted, as shown in FIGS. 27, 30 and 31, such that an upper stage portion 147 on the hand changer 143 side and a lower stage portion 149 on a workpiece W side are coupled to each other by four coupling members 151. The hand changer 143 is attached to the upper stage portion 147.

As shown in FIG. 29, the upper stage portion 147 is comprised of the first upper stage portion 147*a* extending in vertical direction in FIG. 29, the second upper stage portion 147*b* having one end coupled to a slightly upper side of the vertical center of the first upper stage portion 147*a* and the other end extending in lower left direction, and the third upper stage portion 147*c* having one end coupled to a slightly lower side of the vertical center of the first upper portion 147*a* and crossing and coupled with the second upper end portion 147*b* halfway and the other end extending in upper left direction.

The lower stage portion 149 is constituted by mutually coupling the end portions of first, second, third and fourth lower stage portions 149*a*, 149*b*, 149*c* and 149*d* so as to provide a generally trapezoidal shape as a whole.

If the workpiece grip hand 137 is positioned and mounted on the three hand mounting posts 145, the neighborhoods of the both ends of the first upper stage portion 147*a* and the neighborhood of one end of the second upper stage portion 147*b* are positioned and mounted on the hand mounting posts 145. Positioning pins 153 are provided on the upper ends of the two out of these three hand mounting posts 145 to protrude therefrom, respectively, as shown in FIG. 30. While the workpiece grip hand 137 is mounted on the hand mounting posts 145, the positioning pins 153 are inserted into and positioned by positioning holes 154 provided to correspond to the positioning pins 153 on the upper portion, in FIG. 29, of the first upper stage portion 147*a* and the lower left portion, in FIG. 29, of the second upper stage portion 147*b*, respectively.

Further, hand clamp cylinders 157 are provided on the side surface of the hand mounting post 145 located on the upper portion thereof in FIG. 29 (or lower portion in FIG. 28) and on the side surface of the hand mounting post 145 located on the lower left portion thereof in FIG. 29 (or on the upper left portion in FIG. 28) through brackets 155, respectively. The hand clamp cylinder 157 is rotatable around the bracket 155 through a rotation support shaft 159. A clamp arm 165 serving as fixing means is rotatably supported on the tip end of the piston rod 161 of the hand clamp cylinder 157 through a rotation support pin 163. The tip end of a coupling arm 167 is rotatably coupled to a clamp arm 165-side support piece 171 on the side portion of the bracket 155 through a rotation support pin 169. That is, by driving the clamp cylinder 157, the clamp arm 165 rotates about the rotation support pin 169 to thereby clamp and fix the upper portion 147 between the clamp arm 165 and the hand mounting post 145.

The above-stated mechanism for clamping the upper potion 147 by the clamp arm 165 and fixing the workpiece grip hand 137 to the hand mounting post 145 is not always required. This is because the workpiece grip hand 137 has quite large weight and thus even only mounting the mechanism on the hand mounting post 145 does not cause a trouble such as positioning error.

As already stated above, the workpiece W is positioned and gripped by the workpiece grip hand 137 in a state in which the outer panel $W_o$ and the inner panel $W_i$ are assembled with each other in advance. At this time, the neighborhood of the central portion of the outer panel $W_o$ is held by a plurality of vacuum cups 173 attached to the lower stage portion 149 through the opening 174 of the inner panel $W_i$ and also held by an outer drop preventive clamp 174 and an outer clamp 175. On the other hand, the inner panel $W_i$ is positioned by inserting a plurality of location pins 177 attached to the lower stage portion 149 into location holes formed near the central portion and clamped and gripped by a plurality of inner clamps 179, and the hinge attached surface of the inner panel $W_i$ is positioned and held by a hinge surface location clamp 180.

The location pins 177, the inner clamps 179 and the hinge surface location clamp 180 constitute a positioning jig positioning and gripping the inner panel $W_i$ as a whole. In FIG. 31, reference symbol 178 denotes a pad which presses the inner panel $W_i$.

As shown in FIG. 31, the outer drop preventive clamp 174 is constituted such that the clamp cylinder 184 is rotatably supported on a bracket 182 attached to the lower stage portion 149 of the frame 139 of the workpiece grip hand 137 through the rotation support shaft 186 while the clamp arm 188 are rotatably supported on the bracket 182 through the rotation support shaft 190. The tip end of the piston rod 192 of the clamp cylinder 184 is rotatably coupled to the clamp arm 188 through a rotation support pin 194. Namely, by driving the clamp cylinder 184, the clamp arm 188 is rotated and displaced from a position indicated by a two-dot chain line to a position indicated by a solid line to thereby hold the surface (lower surface) of the outer panel $W_o$ by a clamp portion 188*a* located on a lower end position in FIG. 31 and thus prevent the workpiece W from dropping.

Figure 32:
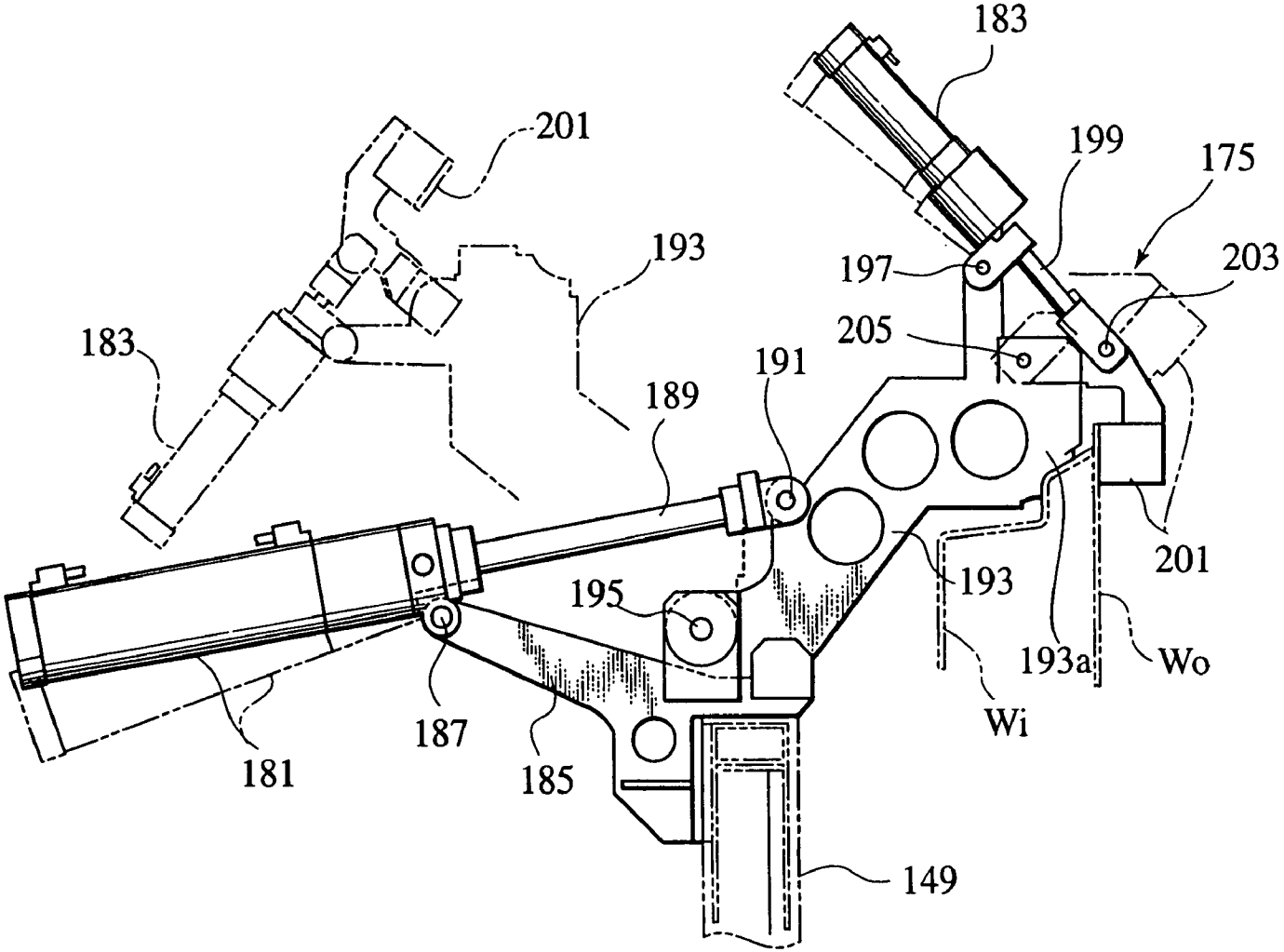
FIG. 32 is a detail view of an outer clamp provided at a workpiece grip hand.

The outer clamp 175 located upward in FIG. 30 is comprised of a main cylinder 181 and a sub-cylinder 183 moved between a solid-line position and a two-dot-chain-line position by the main cylinder 181 as shown in FIG. 32. The main cylinder 181 is rotatably supported on the tip end of a main cylinder support bracket 185 fixed to the lower stage portion 149 through a rotation support shaft 187. The tip end of the piston rod 189 of the cylinder 181 is rotatably coupled to a sub-cylinder support bracket 193 through a rotation support pin 191. The sub-cylinder support bracket 193 is comprised of a presser portion 193*a* which presses the inner surface of the inner panel $W_i$ while moving the sub-cylinder 183 to the solid-line position.

The sub-cylinder support bracket 193 has one end rotatably supported by the lower stage portion 149 through a rotation support shaft 195 and the other end rotatably coupled to the sub-cylinder 183 through a rotation support shaft 197. The tip end of the piston rod 199 of the sub-cylinder 183 is rotatably coupled to a workpiece grip jig 201 through a rotation support pin 203. This workpiece grip jig 201 is rotatably supported by the sub-cylinder support bracket 193 through a rotation support pin 205. Namely, by driving the sub-cylinder 183, the workpiece grip jig 201 rotates about the rotation support pin 205, thereby pressing the peripheral edge of the front surface of the outer panel $W_o$ of the workpiece W, while the workpiece presser portion 193*a* of the sub-cylinder support bracket 193 presses the inner surface of the inner panel $W_i$.

Figure 33:
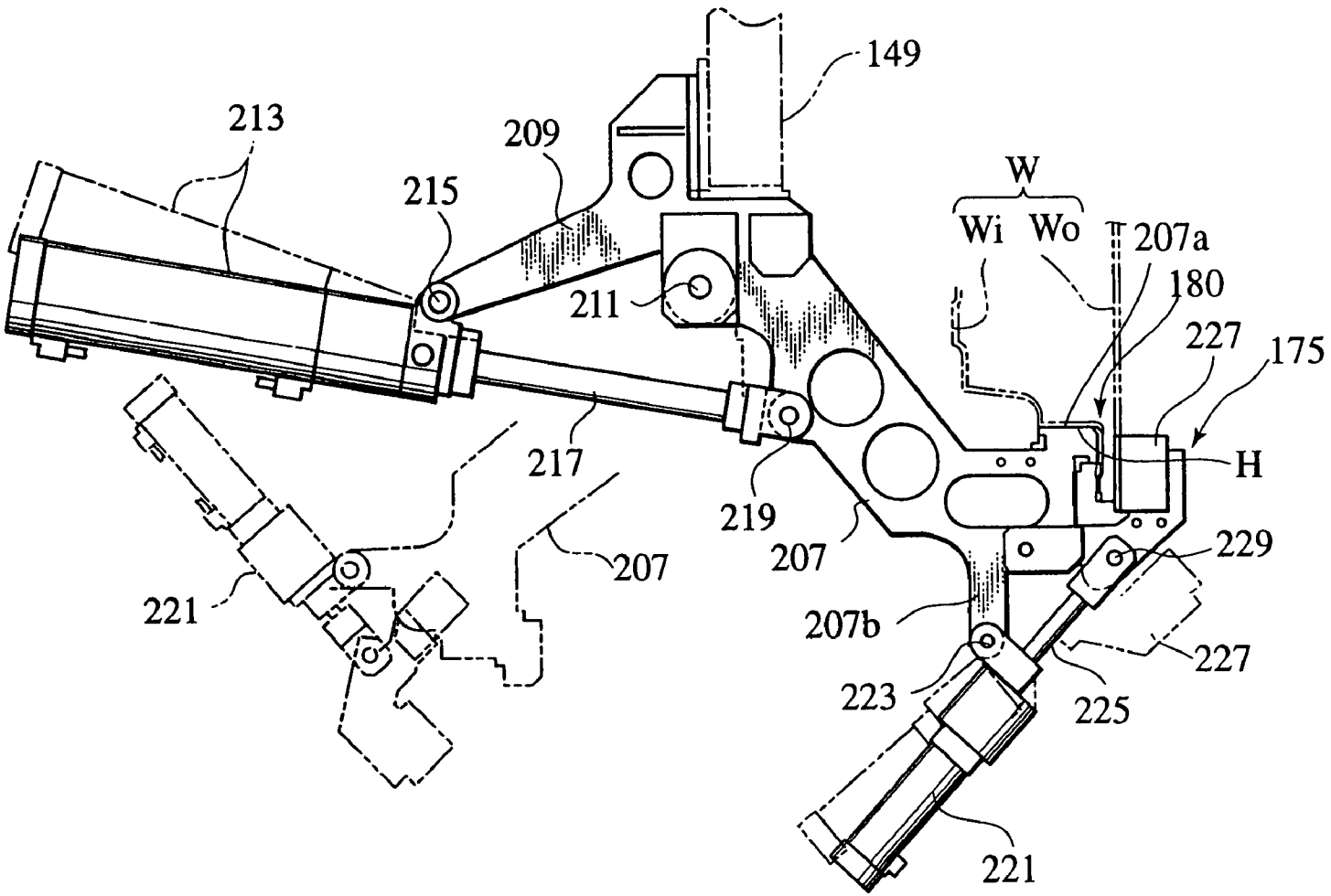
FIG. 33 is a detail view of the outer clamp and a hinge surface location clamp provided at the workpiece grip hand.

The outer clamp 175 located upward in FIG. 30 is paired with a hinge surface location clamp 180 as shown in FIG. 33. The hinge surface location clamp 180 includes a hinge surface positioning portion 207*a* which is formed at a rotation arm 207 and which presses and positions the hinge attached surface H of the inner panel $W_i$.

The left end portion of the rotation arm 207 in FIG. 33 is rotatably supported on a main cylinder support bracket 209 attached to the lower stage portion 149 of the frame 139 through a rotation support shaft 211. The main cylinder 213 is rotatably supported on the tip end of the main cylinder support bracket 209 through a rotation support shaft 215. The tip end of the piston rod 217 of the main cylinder 213 is rotatably coupled to the rotation arm 207 through a rotation support pin 219.

The sub-cylinder 221 is rotatably coupled to the tip end of a protrusion 207*b* of the rotation arm 207 protruding downward in FIG. 33 through a rotation support pin 219. The tip end of the piston rod 225 of the sub-cylinder 221 is rotatably coupled to a workpiece grip jig 227 through a rotation support pin 229. By driving the sub-cylinder 221 while the hinge surface positioning portion 207*a* presses the hinge attached surface H of the inner panel $W_i$, the workpiece grip jig 227 presses the peripheral edge of the front surface of the outer panel $W_o$. Namely, by driving the main cylinder 213, the sub-cylinder 221 moves from the two-dot-chain-line position to the solid-line position, whereby the hinge surface positioning portion 207*a* contacts with the hinge attached surface H. In this state, if the sub-cylinder 221 is driven, the workpiece grip jig 227 contacts with the outer panel $W_o$.

Figure 34:
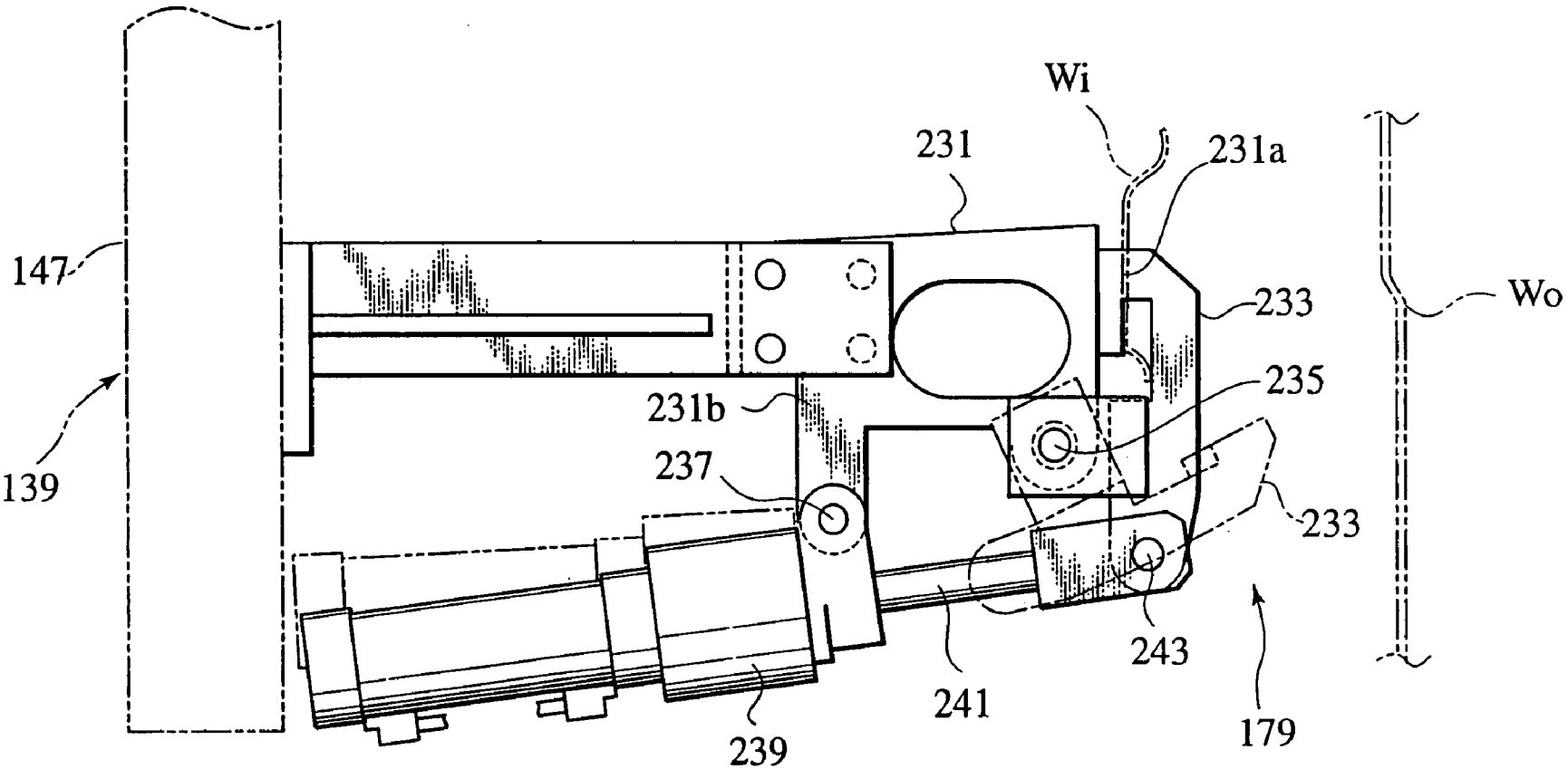
FIG. 34 is a detail view of an inner clamp provided at the workpiece grip hand.

As shown in FIG. 34, the inner clamp 179 clamps the inner panel $W_i$ between the tip end surface 231*a*, on the right in FIG. 34, of a workpiece receiver 231 provided on the lower stage portion 149-side upper stage portion 147 of the frame 139 and a workpiece grip jig 233 while the tip end surface 231*a* contacts with the inner panel $W_i$.

The workpiece grip jig 233 is rotatably supported on a workpiece receiver 231 side through a rotation support shaft 235. A clamp cylinder 239 is rotatably supported on the tip end of a protrusion 231*b*, protruding toward the lower direction in FIG. 34, of the workpiece receiver 231 through a rotation support shaft 237. The tip end of the piston rod 241 of the clamp cylinder 239 is rotatably coupled to the workpiece grip jig 233 through a rotation support pin 243. Namely, by driving this clamp cylinder 239, the workpiece grip jig 233 rotates about the rotation support shaft 243 to move from a two-dot-chain-line position to a solid-line position, thereby clamping the inner panel $W_i$.

Next, the operation of the hemming device constituted as stated above will be described. First, as shown in FIGS. 30 and 31, the workpiece W arranged on a workpiece mounting base, not shown, is gripped by the workpiece grip hand 137 which is held by the robot 141 through the hand changer 143. At this moment, the workpiece W is in a state in which the inner panel $W_i$ is superposed on the outer panel $W_o$ and the inner and outer panels are assembled with each other in advance as in the case of the workpiece W on the hemming die 35 shown in FIG. 27.

In this state, the workpiece grip hand 137 positions the inner panel $W_i$ by inserting the location pins 177 shown in FIG. 30 into the locate holes formed in the vicinity of the central portion, clamps the inner panel $W_i$ using the inner clamp 179 shown in FIG. 34 and positions the hinge attached surface H using the hinge surface location clamp 180 shown in FIG. 33. On the other hand, the workpiece grip hand 137 holds the vicinity of the central portion of the outer panel $W_o$ using the vacuum cups 173 shown in FIGS. 30 and 31 and grips the outer peripheral edge portion thereof using the outer drop preventive clamp 174 shown in FIG. 31 and the outer clamp 175 shown in FIGS. 32 and 33.

The robot 141 transports the workpiece grip hand 137 gripping the workpiece W while positioning the inner panel $W_i$ as described above, onto the hemming die 35 shown in FIG. 27, and sets the workpiece W on the hemming die 35. When setting the workpiece W on the hemming die 35, the C-shaped frame 37 is retreated by driving the slide cylinder 53. Also, just before setting the workpiece W on the hemming die 35, the grip of the outer panel W, by the outer drop preventive clamp 174 and the outer clamp 175 is released to prevent the outer panel $W_o$ from interfering with the hemming die 35 during hemming operation.

When setting the workpiece W on the hemming die 35, the workpiece grip hand 137 is positioned in such a way that the three portions of the upper stage portion 147 of the frame 139 thereof are mounted on the upper ends of the three hand mounting posts 145 and the positioning pins 153, shown in FIG. 30, provided on the upper ends of the two hand mounting posts 145, respectively, are inserted into the positioning holes on the upper stage 147 side. Then, the clamp arm 165 rotates relative to the upper stage portion 147 positioned and mounted on the two hand mounting posts 145 provided with the positioning pins 153 by driving the hand clamp cylinder 157 and the upper stage portion 147 is fixedly clamped. That is to say, the workpiece grip hand 137 is fixed while being positioned and mounted on the hand mounting posts 145.

Thereafter, the robot 141 releases the holding of the workpiece grip hand 137 by using the hand changer 143. In this state, the hemming device moves to a hemming operation. It is assumed that this hemming operation is carried out for all of the working units U1 to U4 simultaneously. If driving the lifter hydraulic cylinder 61 after the C-shaped frame 37 which has been retreated, has advanced until the hemming punch 36 is located above the hemming die 35 and the pre-hemming punch 65 is located to the position indicated by the solid line, then the lifter base 33 is raised and the hemming die 35 as well as the hand mounting post 145 is raised accordingly.

At this moment, it is assumed that the outer peripheral edge portion of the outer panel $W_o$ has been already bent upward in FIG. 27 at almost 90 degrees with respect to the inner panel $W_i$ side and a flange has been thereby formed. When the hemming die 35 is raised, the flange of the outer panel $W_o$ is bent at about 45 degrees.

Next, after lowering the lifter base 33 and thereby lowering the hemming die 35 as well as the workpiece W by driving the lifter hydraulic cylinder 61, the pre-hemming punch 64 is retreated to the position indicated by the two-dot chain line by the swing cylinder 71. Thereafter, the lifter base 33 is raised and the hemming die 35 is raised accordingly by driving the lifter hydraulic cylinder 61, and the flange F of the outer panel $W_o$ provisionally bent at about 45 degrees is abutted on the hemming punch 63, thereby completing the final hemming.

After the completion of the hemming operation, the clamp arm 165 is released to thereby release the clamp 165 from fixing the workpiece grip hand 137. In addition, while retreating the C-shaped frame 37, the robot 141 holds the workpiece grip hand 137 through the hand changer 143 and transports the workpiece to the next step. Another robot may be used for transporting the workpiece W to the next step.

In the hemming device described above, the robot 141 positions the inner panel $W_i$ through the workpiece grip hand 137 and also grips and transports the workpiece W. Due to this, it is not necessary to prepare a dedicated transport device for transporting the workpiece W such as a conveyor and it is possible to make the entire device small in size and simple in constitution. Further, the hinge surface location clamp 180 shown in FIG. 33 positions the inner panel $W_i$ relative to the hinge attached surface H. It is, therefore, possible to enhance accuracy for installing the installation surface of the door to a vehicle body.

Moreover, since the workpiece grip hand 137 positioning and gripping the workpiece W is positioned and mounted on the hand mounting posts 145, positioning accuracy for positioning the workpiece W is improved. Besides, since the hand mounting posts 145 are disposed on the lifter base 33 on which the hemming die 35 is disposed, it is possible to easily ensure the accuracy of the hemming die 35 with respect to the workpiece grip hand 137 (positioning mechanism for the inner panel $W_i$) and, therefore, possible to carry out highly accurate working.

Furthermore, the hemming punch 63 and the pre-hemming punch 65 receiving hemming pressure between the hemming die and the hemming punch 63 and between the hemming die 35 and the pre-hemming punch 65 are attached to the C-shaped frame 37 disposed on the base 29 and separated from the workpiece grip hand 137 for positioning the inner panel $W_i$. Due to this, it is possible to carry out highly accurate working without receiving hemming pressure during hemming.

It should be understood that many modifications and adaptations of the invention will become apparent to those skilled in the art and it is intended to encompass such obvious modifications and changes in the scope of the claims appended hereto.

The entire contents of Japanese Patent Application No. 2000-76797, filed on Mar. 17, 2000, Japanese Patent Application No. 2000-103874, filed on Apr. 5, 2000, and Japanese Patent Application No. 2000-268785, filed on Sep. 5, 2000, are hereby incorporated by reference.

What is claimed is:

1. A hemming device for hemming a peripheral edge of a workpiece using a lower die, on which the workpiece is set, and an upper die arranged above the lower die, the hemming device comprising:

a hand mount provided on said lower die side;

a workpiece grip hand positioning and gripping said workpiece, and movably positionable onto said hand mount so as to position and set the workpiece on said lower die; and a hand transport section holding the workpiece grip hand at a time of transporting the workpiece and releasing the workpiece grip hand onto the hand mount at a time of hemming the workpiece.

2. A hemming device according to claim 1, wherein said upper die is fixed to a device main body and said lower die is disposed, together with said hand mount, on a vertically movable lifter base.

3. A hemming device according to claim 1, wherein said workpiece is a vehicle panel material consisting of an outer panel set on said lower die and an Inner panel having a peripheral edge superposed on a peripheral edge of the outer panel, the peripheral edge of the outer panel being hemmed; and said workpiece grip hand comprises a positioning jig positioning and gripping said inner panel.

4. A hemming device according to claim 3, wherein said vehicle panel material is a door panel; and said positioning jig has a constitution for positioning a hinge attached surface of the inner panel of said door panel.

5. A hemming device according to claim 1, further comprising:

a fixing portion fixing said workpiece grip hand positioned and mounted on said hand mount.

6. A hemming device according to claim 1, wherein said hand transport section is a robot.

7. A hemming method comprising:

positioning and gripping a workpiece in a workpiece grip hand;

holding and transporting the workpiece grip hand by a hand transport section;

mounting said workpiece grip hand on a hand mount so as to set the workpiece on a lower die provided on a hemming device;

releasing said workpiece grip hand by said hand transport section on said hand mount; and hemming said workpiece by said lower die and an upper die located above said lower die provided on the hemming device.

* * * * *